US010544596B2

(12) United States Patent
Swanson et al.

(10) Patent No.: US 10,544,596 B2
(45) Date of Patent: Jan. 28, 2020

(54) ANTI-SLIP, LIQUID MANAGEMENT FLOORING SURFACE COVER ARTICLE AND METHOD OF MANUFACTURE

(71) Applicant: 3M INNOVATIVE PROPERTIES COMPANY, St. Paul, MN (US)

(72) Inventors: Steven P Swanson, Blaine, MN (US); Kurt J Halverson, Lake Elmo, MN (US); James P. Gardner, Jr., Stillwater, MN (US); Lauren K Carlson, St. Paul, MN (US); Jonathan C Dilley, Minneapolis, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 15/549,399

(22) PCT Filed: Jan. 18, 2016

(86) PCT No.: PCT/US2016/013794

§ 371 (c)(1),
(2) Date: Aug. 8, 2017

(87) PCT Pub. No.: WO2016/130279

PCT Pub. Date: Aug. 18, 2016

(65) Prior Publication Data

US 2018/0038116 A1 Feb. 8, 2018

Related U.S. Application Data

(60) Provisional application No. 62/115,186, filed on Feb. 12, 2015.

(51) Int. Cl.
*E04F 15/02* (2006.01)
*A47G 27/02* (2006.01)

(52) U.S. Cl.
CPC ..... *E04F 15/02161* (2013.01); *A47G 27/02* (2013.01); *E04F 15/0215* (2013.01); *E04F 15/02188* (2013.01)

(58) Field of Classification Search
CPC .... A47G 27/0225; A47G 27/02; A47K 3/002; A47L 23/266; A47L 23/24; A47L 23/263;
(Continued)

(56) References Cited

U.S. PATENT DOCUMENTS 2,818,824 A * 1/1958 Read ..... B28B 1/526 162/117
5,011,642 A * 4/1991 Welygan ..... B29C 48/30 264/167

(Continued)

FOREIGN PATENT DOCUMENTS

DE 4120884 1/1992
EP 2520736 A1 * 11/2012 ..... E04C 2/22

(Continued)

OTHER PUBLICATIONS

Translation of EP2520736. (Year: 2012).*

*Primary Examiner* — Catherine A. Simone
(74) *Attorney, Agent, or Firm* — Daniel J. Iden

(57) ABSTRACT

An anti-slip, liquid management cover article for a flooring surface. The article includes a film defining a working face. A microstructured surface is formed at the working face, and includes a plurality of primary ridges and capillary microchannels each having a bottom surface. Each primary ridge is an elongated body having a length. A shape of a portion of at least one of the primary ridges is non-uniform in a direction of the length. The capillary microchannels facilitate spontaneous wicking of liquid. With this construction, the non-uniform shape establishes an elevated coefficient of friction at the working face as measured in multiple directions. The cover article minimizes the risk of pedestrian slippage, even in the presence of water or other liquids.

11 Claims, 11 Drawing Sheets

(58) Field of Classification Search
CPC ..... A47L 23/26; A47L 23/22; B32B 2471/04; B32B 2307/744; E04F 15/02161; E04F 15/02188; Y10T 428/24744; Y10T 428/2457; Y10T 428/24479
USPC ..... 4/581, 582; 15/215, 238; 428/167, 188
See application file for complete search history.

(56) References Cited

U.S. PATENT DOCUMENTS

| | | | | |
|---|---|---|---|---|
| 7,401,441 | B2 | 7/2008 | Zimmerle | |
| 8,460,779 | B2 * | 6/2013 | Gupta | B64C 21/10 428/156 |
| 2002/0146540 | A1 | 10/2002 | Johnston | |
| 2004/0091674 | A1 | 5/2004 | Altshuler | |
| 2004/0148892 | A1 | 8/2004 | Kitakado | |
| 2010/0092745 | A1 | 4/2010 | Welton | |

FOREIGN PATENT DOCUMENTS

| | | |
|---|---|---|
| JP | S57176544 | 11/1982 |
| JP | H717885 | 7/1995 |
| JP | 3141463 | 5/2008 |
| JP | 2009131350 | 6/2009 |
| WO | WO 2008/051819 | 5/2008 |
| WO | WO 2012/151404 | 11/2012 |

* cited by examiner

ANTI-SLIP, LIQUID MANAGEMENT FLOORING SURFACE COVER ARTICLE AND METHOD OF MANUFACTURE

CROSS REFERENCE TO RELATED APPLICATIONS

This application is a national stage filing under 35 U.S.C. 371 of PCT/US2016/013794, filed Jan. 18, 2016, which claims the benefit of U.S. Provisional Application No. 62/115,186, filed Feb. 12, 2015, the disclosure of which is incorporated by reference in its/their entirety herein.

BACKGROUND

The present disclosure relates to flooring surface covers. More particularly, it relates to slip resistant, film-based covers that can be applied to existing flooring surfaces.

The presence of standing water or other liquid on a floor surface can be highly problematic, for example in facilities or other locales with high pedestrian traffic. Often the water decreases the coefficient of friction of the flooring surface, increasing the risk of pedestrian slippage. Standing water can also damage the flooring surface over time.

Relatively thick mats, rugs, pads and similar products utilizing woven or nonwoven strands are conventionally available for temporary placement on flooring surfaces at which liquid collection and pedestrian slippage are a concern. While readily available, mats, rugs and similar products are relatively bulky and expensive, and must be periodically cleaned. Further, the materials employed often retain water for an extended period of time, with the absorbed liquid reducing the coefficient of friction at the article's surface. In some instances, an active liquid removal device (e.g., a vacuum source) can be incorporated with the mat to remove accumulated water. Though viable, the liquid removal device represents an additional cost.

Polymer film-type products intended to protect a flooring surface are also available. These film-based articles can be formatted for ready application to, and subsequent removal from, a flooring surface (e.g., via a repositionable adhesive backing), and are relatively inexpensive. In some instances, hardened particles can be embedded into the polymer film floor cover to create an anti-slip feature. Unfortunately, the elevated coefficient of friction provided by such features will often diminish in the presence of water or other liquid, and the embedded particles represent an additional cost. Conversely, other polymer film-based articles potentially useful as a flooring surface cover are designed to promote management or removal of liquid collected on the film's surface via a series of uniformly structured troughs or channels. The channels distribute accumulated liquid across a large surface of the film for more rapid evaporation and/or can direct liquid flow to a removal zone at which an active liquid removal device (vacuum source, absorbent material, etc.) is located. By managing the presence of accumulated liquid at the film's surface, the negative effect the liquid might otherwise have on coefficient of friction is inherently minimized. However, liquid management film is typically not considered to be an optimal solution for pedestrian slippage concerns, especially in high traffic areas. Pointedly, the structured troughs generate a directional bias whereby the frictional coefficient exhibited at the film's surface significantly varies in different directions, leading to an increased (and unexpected) slip risk when a pedestrian approaches the film from certain directions.

In light of the above, a need exists for flooring surface cover articles providing liquid management and multidirectional anti-slip features.

SUMMARY

Some aspects in accordance with principles of the present disclosure are directed toward an anti-slip, liquid management cover article for application to a flooring surface. The article includes a film defining opposing, first and second major faces. A microstructured surface is formed at the first major face, and forms a plurality of primary ridges and a plurality of capillary microchannels each having a bottom surface. Respective ones of the capillary microchannels are defined between spaced apart adjacent ones of the primary ridges. Each of the primary ridges is an elongated body having a length greater than a height and a width. A shape of a portion of at least one of the primary ridges is non-uniform in a direction of the length of the primary ridge. The capillary microchannels are configured to facilitate spontaneous wicking of liquid along the capillary microchannels. With this construction, the non-uniform shape of the primary ridge(s) establishes an elevated coefficient of friction at the first major face as measured in multiple directions. When applied to a flooring surface, then, the cover article minimizes the risk of pedestrian slippage, even in the presence of water or other liquids. In some embodiments, a coefficient of friction at the first major face as measured in accordance with ASTM D2047 is at least 0.8 in directions parallel with and perpendicular to the length of the primary ridges. In other embodiments, each of the primary ridges defines a base segment extending from the bottom surface, and a head segment extending from the base segment. The non-uniform shape is provided along the head segment and is thus spaced from the bottom surface of the corresponding capillary microchannel so as to not interfere with a capillary action of the microchannel. In yet other embodiments, the microstructured surface further includes a plurality of secondary ridges between adjacent ones of the primary ridges, respective ones of the capillary microchannel being partially defined by one or more of the secondary ridges. A height of each of the secondary ridges is less than a height of the primary ridges, with the non-uniformly shaped segment of the primary ridge(s) being spaced away from the secondary ridges.

Other aspects in accordance with principles of the present disclosure are directed toward a method for forming an anti-slip, liquid management cover article for application to a flooring surface. The method includes providing a precursor article including a film defining opposing, first and second major faces. A microstructured surface is formed at the first major face of the precursor article, and includes a plurality of primary ridges and a plurality of capillary microchannels. Each of the primary ridges is an elongated body having a length greater than a height and a width. Further, a shape of an entirety of each of the primary ridges of the precursor article is substantially uniform in a direction of the corresponding length. The method further includes altering a shape of a segment of at least one of the primary ridges of the precursor article such that the shape of the segment is rendered non-uniform in a direction of the corresponding length. In some embodiments, the step of altering a shape includes plastically deforming the segment of the primary ridge, such as by passing the primary ridge against a sharp edge.

Unless otherwise specified, the following terms should be construed in accordance with the following definitions:

Fluid control film or fluid transport film refers to a film or sheet or layer having at least one major face (or working face) comprising a microreplicated pattern capable of manipulating, guiding, containing, spontaneously wicking, transporting, or controlling, a fluid such as a liquid.

Microreplication means the production of a microstructured surface through a process where the structured surface features retain an individual feature fidelity during manufacture.

Microstructured surface refers to a surface that has a configuration of features in which at least two dimensions of the features are microscopic. The term "microscopic" refers to features of small enough dimension so as to require an optic aid to the naked eye when viewed from a plane of view to determine its shape. A microstructured surface can include few or many microscopic features (e.g., tens, hundreds, thousands, or more). The microscopic features can all be the same, or one or more can be different. The microscopic features can all have the same dimensions, or one or more can have different dimensions. For example, a microstructured surface can include features that are precisely replicated from a predetermined pattern and can form, for example, a series of individual open capillary microchannels.

Plastic deformation refers to a process in which permanent deformation is caused by a sufficient load. It produces a permanent change in the shape or size of a solid body without fracture, resulting from the application of sustained stress beyond the elastic limit.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

The flooring surface cover articles discussed below are configured to wick liquid into hydrophilic microreplicated channels and to disperse the liquid by capillary action across the article's surface, thus significantly increasing the surface to volume ratio of the liquid and promoting evaporation. Further, the flooring surface cover articles of the present disclosure are configured to provide an elevated coefficient of friction as measured in multiple directions, including perpendicular and parallel to the direction of the channels.

Figure 1A:
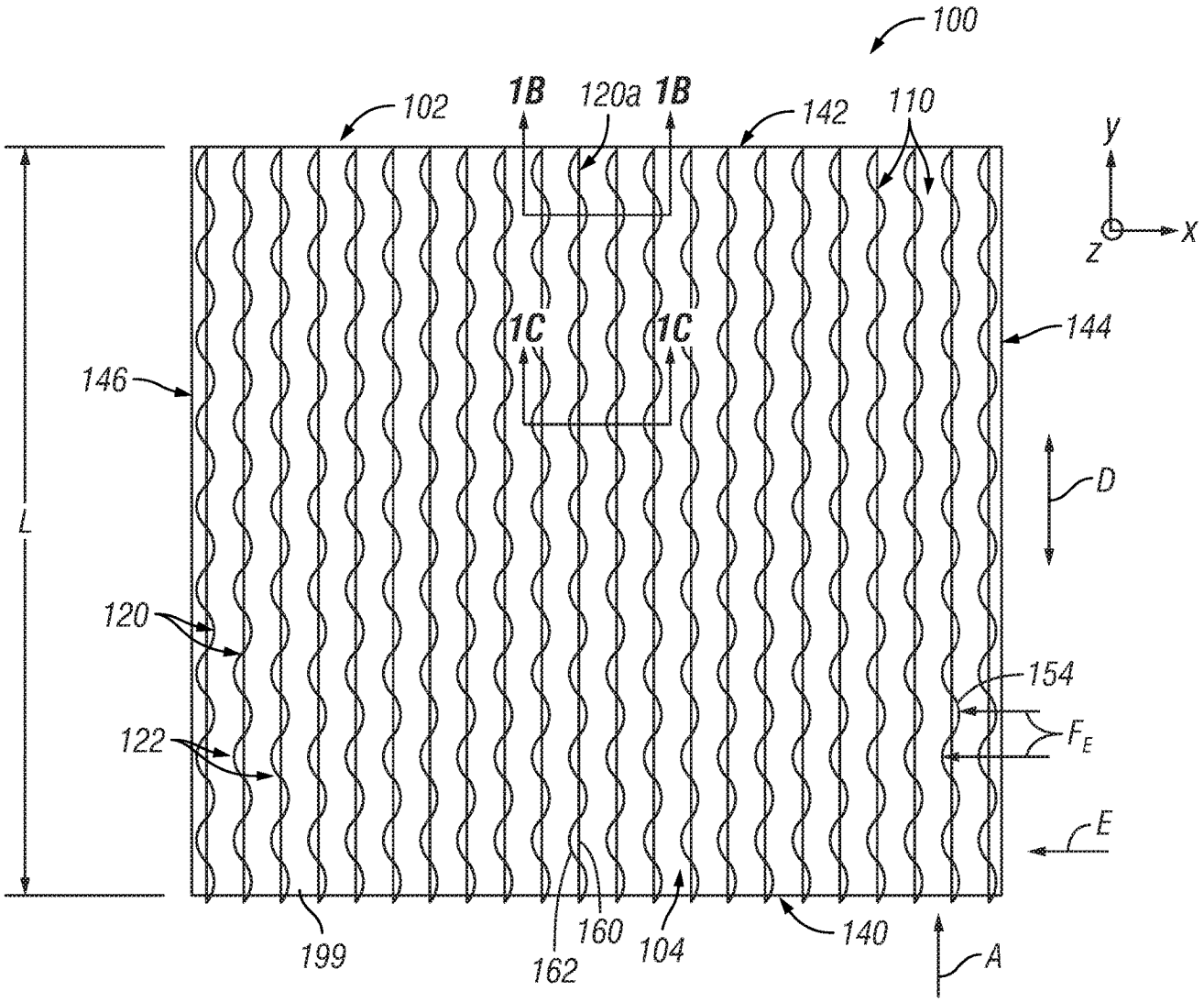
FIG. 1A is a simplified, top plan view of a flooring surface cover article in accordance with principles of the present disclosure.
Figure 1B:
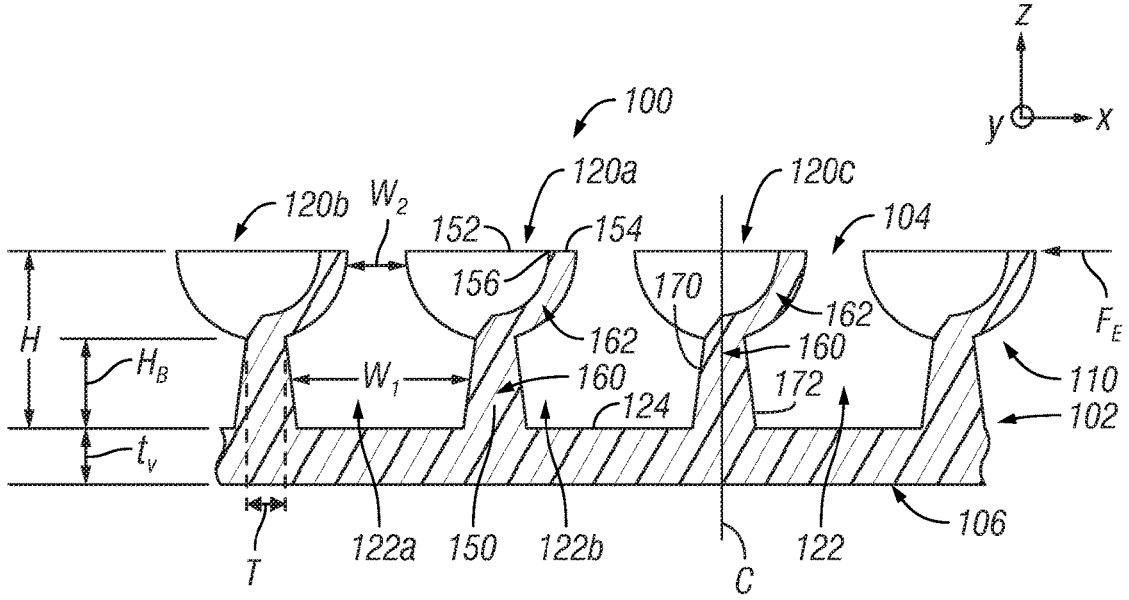
FIG. 1B is an enlarged, cross-sectional view of a portion of the cover article of FIG. 1A, taken along the line 1B-1B.

One embodiment of a flooring surface cover article 100 in accordance with principles of the present disclosure is shown in FIGS. 1A and 1B. The article 100 includes a film (e.g., a fluid control film) 102 defining opposing, first and second major faces 104, 106 (as a point of reference, in the view of FIG. 1A, the first major face 104 is visible and the second major face 106 is hidden). The first major face 104 represents a working face of the article 100, and during use is arranged opposite the flooring surface to which the article 100 is applied. A microstructured surface 110 (referenced generally) is formed at the first major face 104, and includes or forms a plurality of spaced apart primary ridges 120 and a plurality of capillary microchannels 122. In general terms, respective ones of the capillary microchannels 122 are defined between adjacent ones of the primary ridges 120 (e.g., FIG. 1B identifies a first capillary microchannel 122*a* defined between adjacent, first and second primary ridges 120*a*, 120*b*), with each of the capillary microchannels 122 having a bottom surface 124. Stated otherwise, the primary ridges 120 project (upwardly relative to the orientation of FIG. 1B) from the corresponding bottom surface 124.

In some embodiments, each of the primary ridges 120 (and thus each of the capillary microchannels 122) extends across the first major face 104 in a similar fashion or direction. For example, the film 102 can be viewed as having first-fourth edges 140-146 (the first edge 140 is opposite the second edge 142, and the third edge 144 is opposite the fourth edge 146). The edges 140-146 combine to create a shape in the x, y plane (FIG. 1A) having a longitudinal (or x-axis) direction and a lateral (or y-axis) direction. In some embodiments, the longitudinal (x) and lateral (y) directions can also be viewed as the web (or machine) and cross-web directions, respectively, in accordance with accepted film manufacture conventions. The primary ridges 120 and the capillary microchannels 122 can extend from and between a pair of the edges 140-146. For example, with the exemplary embodiment of FIG. 1A, the primary ridges 120 and capillary microchannels 122 each extend in the lateral or cross-web direction (y) between the first and second edges 140, 142. Alternatively, the primary ridges 120 and the capillary microchannels 122 can extend in the longitudinal or web direction (x) between the third and fourth edges 144, 146. In yet other embodiments, the primary ridges 120 and the capillary microchannels 122 can be oblique relative to the longitudinal and lateral axes (x, y).

With the above conventions in mind, each of the primary ridges 120 is an elongated body defining a length L (FIG. 1A), a height H (FIG. 1B), and a width T (FIG. 1B). The length L is greater than the height H and the width T. Due to this elongated shape, the primary ridges 120 (and the capillary microchannels 122) can be viewed as having a common direction or direction of extension D. While the direction of extension D is the same as the cross-web (or y-axis) direction of the film 102 in the exemplary embodiment of FIG. 1A, in other embodiments the direction of extension D of the primary ridges 120 and the capillary microchannels 122 can be perpendicular or oblique to the cross-web direction (y-axis). A shape of a portion of at least one of the primary ridges 120 is non-uniform in the direction of extension D (i.e., along the corresponding length L), with this non-uniform shape establishing an elevated, multidirectional coefficient of friction at the working face 104 as described in greater detail below. With specific reference to the first primary ridge 120*a* of FIG. 1B, projection of the primary ridge 120*a* from the bottom surface 124 can be viewed as establishing a fixed end 150 opposite a free end 152. Opposing corners 154, 156 are defined at the free end 152. A base segment 160 extends from the fixed end 150 (in a direction of the free end 152), and a head segment 162 extends from the free end 152 (in a direction of the fixed end 150). The non-uniform shape is defined along the head segment 162.

Figure 1C:
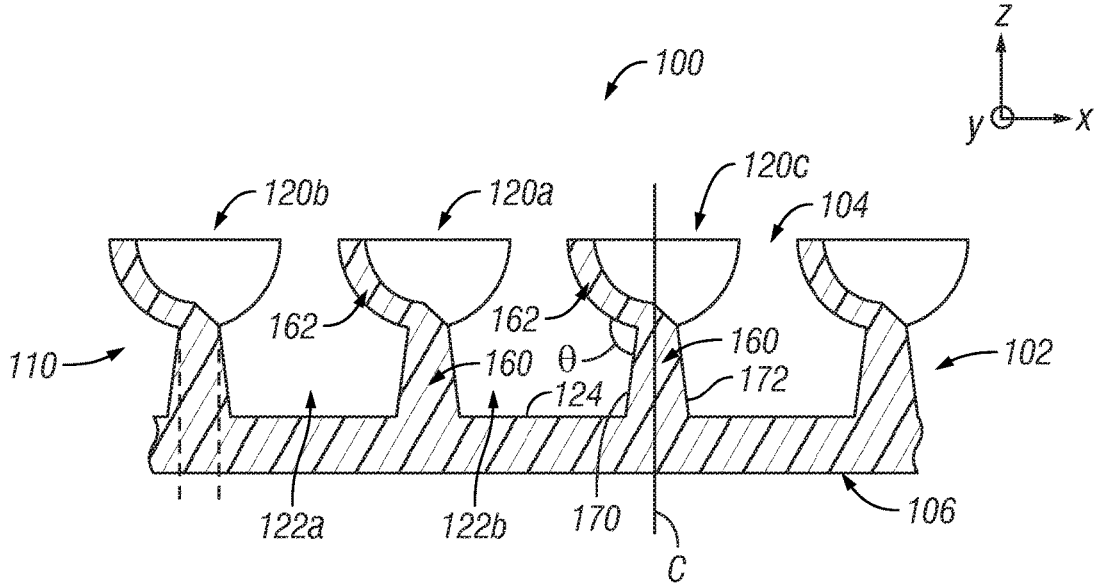
FIG. 1C is an enlarged, cross-sectional view of another portion of the cover article of FIG. 1A, taken along the line 1C-1C.

More particularly, a cross-sectional shape of the base segment 160 in a plane perpendicular to the length L or the direction of extension D (e.g., the x, z plane of FIG. 1B) is substantially uniform or substantially constant (e.g., within 5% of a truly uniform or constant relationship) along at least a portion, optionally an entirety, of the length L. In some embodiments, the base segment 160 is substantially linear (e.g., within 5% of a truly linear relationship) along at least a portion, optionally an entirety, of the length L. By way of reference, FIG. 1C illustrates a cross-section of the first primary ridge 120*a* at a different location from that of the cross-section of FIG. 1B along the length L of the first primary ridge 120*a*; a comparison of FIGS. 1B and 1C reveals that the cross-sectional shape of the base segment 160 is substantially uniform or substantially constant.

In contrast, a cross-sectional shape of the head segment 162 in a plane perpendicular to the length L or the direction of extension D is non-uniform (e.g., a deviation in shape of at least 10%) along at least a portion, optionally an entirety, of the length L. In some embodiments, the head segment 162 has an undulating or oscillating shape along the length L as reflected by FIG. 1A. While FIG. 1A generally reflects the oscillating shape of the primary ridges 120 being in phase with each other, in other embodiments, the oscillating shape of one or more of the primary ridges 120 can be out of phase with others of the primary ridges 120. A comparison of FIGS. 1B and 1C further reveals the non-uniform shape of the head segment 162 along the length L.

The non-uniform shape of the head segment 162 can alternatively be characterized with reference to a central plane C established by the substantially uniform (optionally substantially linear) shape of the base segment 160. The primary ridges 120 each form opposing major faces 170, 172, with the corresponding width T being defined as the distance between the major faces 170, 172. With this in mind, FIG. 1B reflects that in a cross-sectional plane perpendicular to the length L or the direction of extension D (e.g., the x, z plane), the opposing major faces 170, 172 along the base segment 160 are substantially symmetrical (e.g., within 5% of a truly symmetrical relationship) relative to the central plane C. This substantially symmetrical relationship is maintained along at least a portion, optionally an entirety, of the length L (as reflected, for example, by a comparison with the view of FIG. 1C). Conversely, the opposing major faces 170, 172 are non-symmetrical (e.g., a deviation of at least 10%) relative to the central plane C along the head segment 162. For example, at the location of the cross-section of FIG. 1B (relative to the length L), the first and second major faces 170, 172 are both off-set to the same side of the central plane C along the head segment 162. At the location of the cross-section of FIG. 1C, the first and second major faces 170, 172 are both off-set at an opposite side of the central plane C (as compared to the off-set arrangement of FIG. 1B). At other locations along the length L, the first and second major face 170, 172 at the head segment 162 can have other relationships relative to the central plane C.

The non-uniform, undulating shape of the head segment 162 entails projection of the primary ridge 120*a* "toward" the adjacent primary ridges 120 (e.g., the second and third primary ridges 120*b*, 120*c* in FIGS. 1B and 1C) at one or more locations along the length L, decreasing an effective width along an upper region of the corresponding capillary microchannels 122. In other words, the head segment 162 projects "into" a width of, or overhangs, the corresponding capillary microchannel 122 as otherwise established at the base segment 160. For example, FIG. 1B identifies a base channel width $W_1$ of the first capillary microchannel 122*a* between the base segments 160 of the first and second primary ridges 120*a*, 120*b*. An effective head channel width $W_2$ is defined between the head segments 162, and represents the lateral distance (e.g., along the x axis in FIGS. 1B and 1C) between the point at which the head segment 162 of the first primary ridge 120*a* is closest to the central plane C of the second primary ridge 120*b* (at any location along the length L of the first primary ridge 120*a*) and the point at which the head segment 162 of the second primary ridge 120*b* is closest to the central plane C of the first primary ridge 120*a* (at any location along the length L of the second primary ridge 120*b*). The effective head channel width $W_2$ is less than the base channel width $W_1$. FIGS. 1B and 1C illustrate that the effective head channel width $W_2$ is not necessarily an in-plane width or lateral distance between the head segments 162 (e.g., where the undulating shape of the first and second primary ridges 120*a*, 120*b* are in phase with one another (as in FIGS. 1A-1C), an in-plane width or lateral distance between the head segments 162 is not necessarily less than the base channel width $W_1$ but is off-set relative to the base channel with $W_1$). With embodiments in which the first and second primary ridges 120*a*, 120*b* have a similar shape and construction (including a shape of the base segment 160 of each of the primary ridges 120*a*, 120*b* being substantially uniform or substantially linear along the corresponding length L), the base channel width $W_1$ can be substantially uniform along at least a portion of, optionally an entirety of, the first capillary microchannel 122*a* in the direction of extension D for reasons made clear below. A similar relationship is formed along the second capillary microchannel 122*b*. By projecting into the capillary microchannels 122*a*, 122*b* at various locations (spaced from or above the bottom surface 124), the head segment 162 generates a surface "over" the capillary microchannels 122*a*, 122*b* and against which a frictional interface (e.g., kinetic frictional interface) with an external object can be established (e.g., with a pedestrian's shoe (not shown)), thereby increasing a coefficient of friction at the first face 104 in the direction D of the capillary microchannels 122.

The oscillating shape of the head segment 162 of the first primary ridge 120*a* can alternatively be described as intermittently overhanging one or both of the capillary microchannels 122*a*, 122*b*. For example, at the location of the cross-sectional plane of FIG. 1B, the head segment 162 of the first primary ridge 120*a* overhangs the second capillary microchannel 122*b* (creating an undercut between the head segment 162 and the floor 124 of the second capillary microchannel 122*b*) and does not overhang the first capillary microchannel 122*a*; conversely, at the location of the cross-sectional plane of FIG. 1C, the head segment 162 of the first primary ridge 120*a* overhangs the first capillary microchannel 122*a* and does not overhang the second capillary microchannel 122*b*. With this in mind, the head segment 162 extends from the corresponding base segment 160 at an extension angle θ (identified in FIG. 1C), with the oscillating shape of the head segment 162 establishing localized minima of the extension angle θ (i.e., most pronounced projection of the head segment 162 over the corresponding capillary microchannel 122). FIGS. 1B and 1C reflect two examples of the localized minima of the extension angle θ. The localized minima of the extension angle θ are in the range of 90°-170° in some embodiments, optionally in the range of 91°-120°.

While the major faces 170, 172 along the head segment 162 are illustrated in FIGS. 1B and 1C as being relatively smooth, in other embodiments, a surface of one or both of the major faces 170, 172 along the head segment 162 can be roughened or irregular, such as by randomly formed protrusions and/or cavities. This roughness can be imparted during a shape alteration manufacturing step as described below, and can be achieved without the addition of particles embedded into the film 102.

A pedestrian (or other object) may randomly approach and then contact the working face 104 of the flooring surface cover article 100 from various directions, including a direction perpendicular to the direction of extension D (identified by the arrow E in FIG. 1A) or a direction parallel to the direction of extension D (identified by the arrow A in FIG. 1A). When moving in the perpendicular direction E, the object will readily contact a corner (e.g., the corner 154) of one or more of the primary ridges 120 in multiple locations (because the primary ridges 120 and thus the corresponding corners 154, 156 are continuous in the direction of extension D and effectively substantially perpendicular to the perpendicular direction E) along a line of contact that is non-parallel to the perpendicular direction E, creating a substantive kinetic frictional interface. This interface in the perpendicular direction E is schematically reflected in FIGS. 1A and 1B by the arrows FE. The primary ridge(s) 120 exerts a distinct frictional force on to the object at the object/corner interface due to the relatively large number of points of contact and the so-contacted corner 154 being non-parallel to the perpendicular direction E, thus resisting sliding or slippage of the object along the working face 104 in the perpendicular direction E.

Figure 2A:
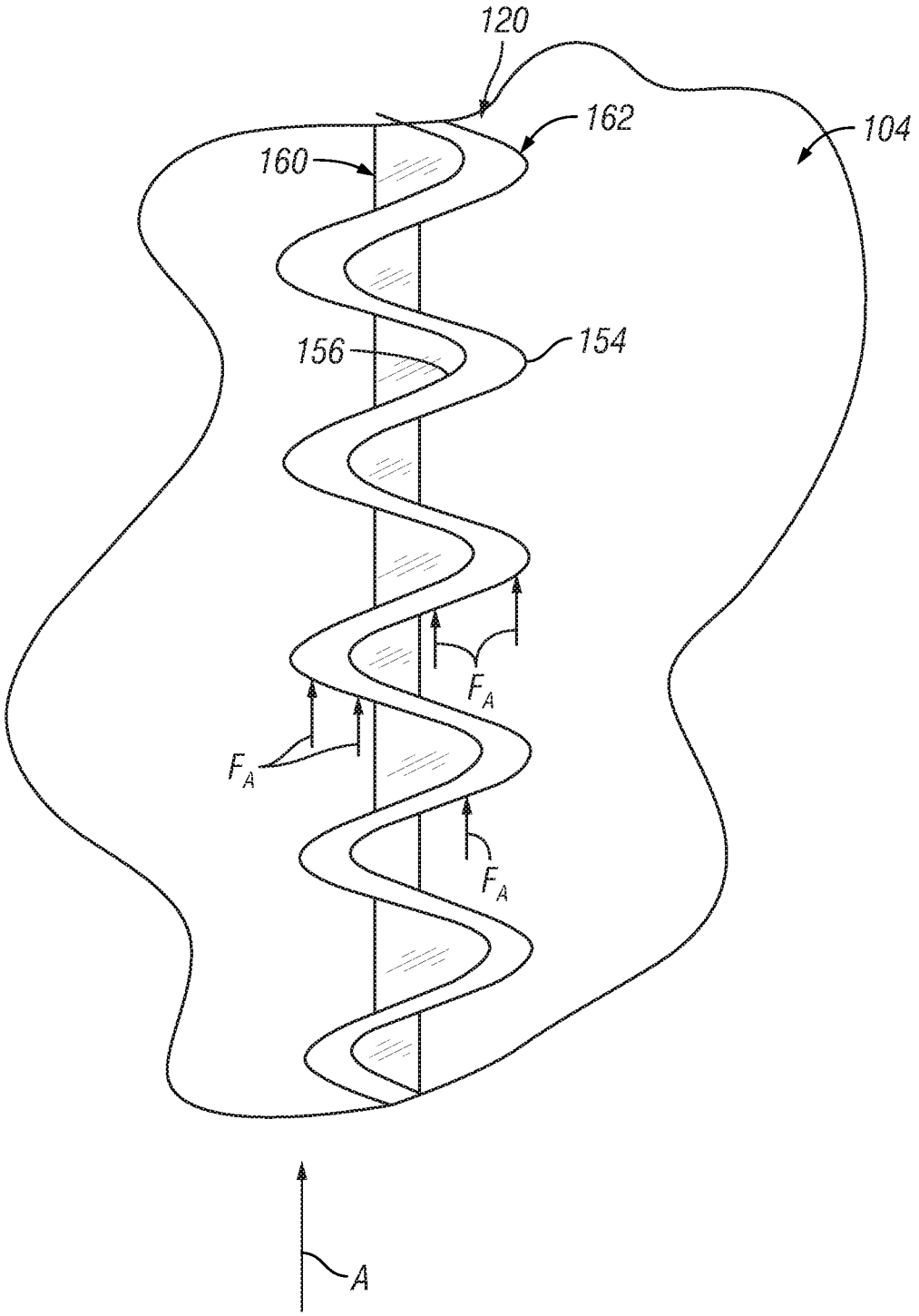
FIG. 2A is an enlarged, simplified top view of a primary ridge included with the cover article of FIG. 1A and schematically reflecting frictional interface with an object.
Figure 2B:
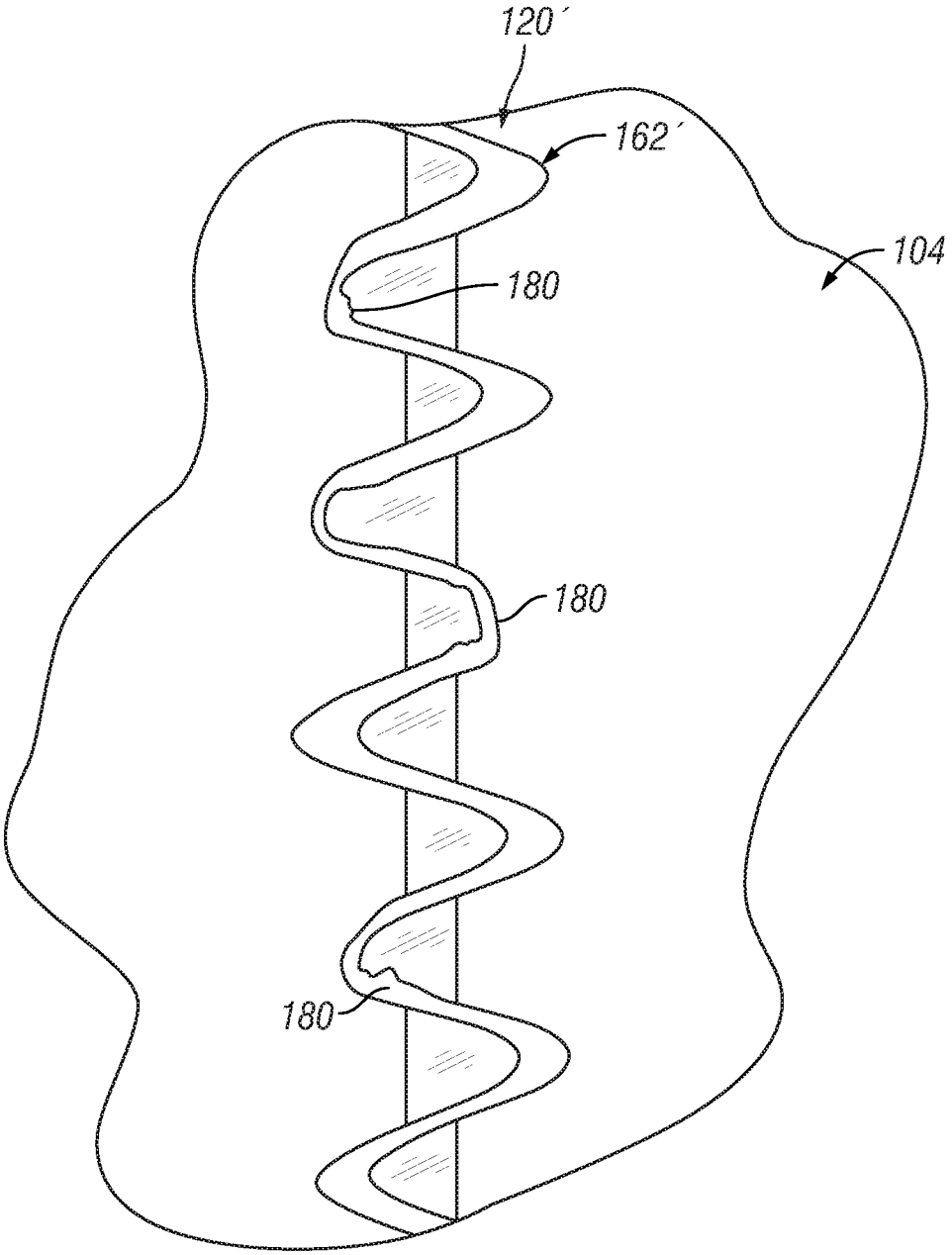
FIG. 2B is an enlarged, simplified top view of a portion of another embodiment primary ridge in accordance with principles of the present disclosure and schematically reflecting frictional interface with an object.

A similar, distinct frictional interface is established between one or more of the primary ridges 120 and an object moving in the parallel direction A. For example, an enlarged portion of one of the primary ridges 120 is shown in isolation in FIG. 2A. As shown, the undulating shape of the head segment 162 arranges various portions of the corners 154, 156 to be non-parallel to the parallel direction A at various locations. As a result, an object moving in the parallel direction A will readily contact one or both of the corners 154, 156 at various regions along a line of interface that is non-parallel to the parallel direction A, creating a substantive kinetic frictional interface as indicated by the arrows $F_A$. The primary ridge 120 exerts a distinct frictional force on to the object at the object/corner interfaces due to the relative large number of points of contact and the so-contacted regions of the corners 154, 156 being non-parallel to the parallel direction A, thus resisting sliding or slippage of the object along the working face 104 in the parallel direction A. As generally reflected by the alternative primary ridge 120' of FIG. 2B, with embodiments in which fabrication imparts random variations or non-uniformities into the head segment 162' (identified at 180 in FIG. 2B), additional surface roughness, and thus an even further enhanced frictional interface or coefficient of friction, is provided at the working face 104.

The non-biased or multidirectional frictional or anti-slip properties at the working face of the flooring surface cover articles of the present disclosure can be characterized in various fashions, for example by comparing a coefficient of friction or slip resistance factor of the working face (as measured in accordance with accepted industry standards (e.g., ASTM D2047, a slipmeter or similar device (e.g., a BOT-3000E tribometer available from Regan Scientific Instruments), etc.)) in at least two directions that are perpendicular to one another (e.g., the parallel and perpendicular directions A, E described above). With some embodiments of the present disclosure, the two coefficient of friction values or slip resistance factors are within 15% of one another, alternatively within 10%. For example, the static coefficient of friction "value" for a particular surface as generated by many accepted testing standards and slip meters will be in the range of 0.01 to about 1.0. Within this conventional range, the coefficient of friction at the working face of the flooring surface cover articles of the present disclosure is at least 0.75 in a first direction and in a second direction perpendicular to the first direction (e.g., the parallel and perpendicular directions A, E), optionally at least 0.80. In other embodiments, the coefficient of friction is at least 0.75, optionally at least 0.80, in any direction.

Figure 3:
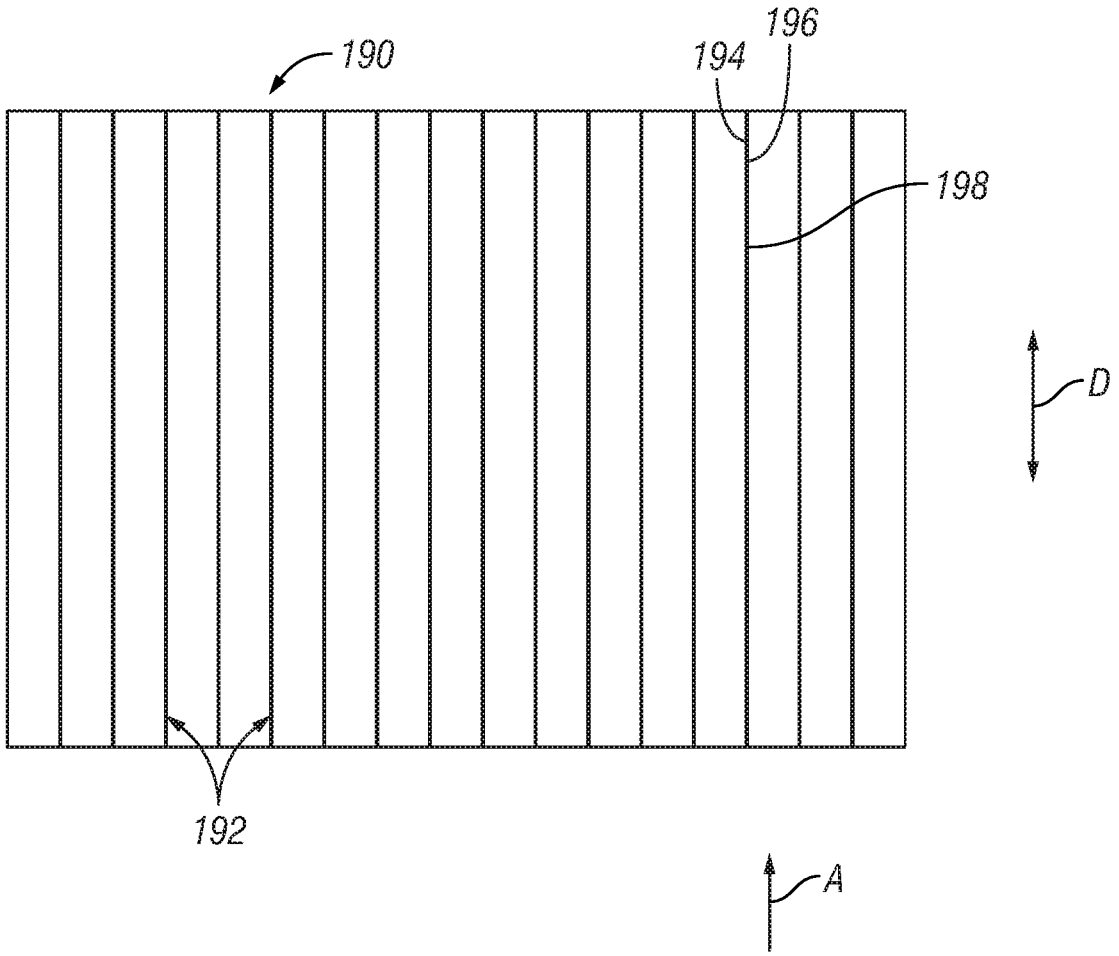
FIG. 3 is a simplified, top plan view of a microstructured film presenting a directionally biased frictional concern overcome by the cover articles of the present disclosure.

By way of comparison, FIG. 3 illustrates, in simplified form, portions of a microstructured film 190 having elongated ridges 192 that are uniformly shaped and substantially linear in the direction of extension D. Opposing corners 194, 196 established at a free end 198 of the ridges 192 are substantially parallel with the direction of extension D, and thus with the parallel direction A. An object contacting the ridges 192 in the parallel direction A interfaces with the corners 194, 196 along a line of interface that is substantially parallel with the parallel direction A. As a result, the ridges 192 exert minimal, if any, frictional force on to the object at the object/corner interface, and do not resist sliding or slippage of the object in the parallel direction A. The flooring surface covers of the present disclosure overcome the anti-slip deficiencies of the microstructured film 190.

Returning to FIGS. 1A and 1B, the non-uniform shape described above can be provided with only one, more than one, or all of the primary ridges 120. Where two or more of the primary ridges 120 embody the non-uniform shape, the so-constructed primary ridges 120 can be identical or can be different. Further, the non-uniform shape can be provided along only a portion of the length L of one or more of the primary ridges 120, along at least a majority of the length L of one or more of the primary ridges 120, or along an entire length L of one or more of the primary ridges 120. In some embodiments, each pair of adjacent primary ridges 120 are equally spaced apart. In other embodiments, the spacing of various pairs of the adjacent primary ridges 120 may be at least two different distances apart.

The capillary microchannels 122 are configured to provide capillary movement of liquid in the channels 122 and across the working face 104. The capillary action wicks the liquid to disperse it across the working face 104 so as to increase the surface to volume ratio of the liquid and enable more rapid evaporation. In some embodiments, one or more or all of the capillary microchannels 122 are open at a corresponding edge 140-146 of the film 102, establishing a channel opening 199. The dimensions of the channel openings 199 can be configured to wick liquid fluid that collects the corresponding edge 140-146 into the channels 122 by capillary action. The shape of the capillary microchannel 122 (at least along the base segment 160 of the corresponding, adjacent primary ridges 120), channel surface energy, and liquid surface tension determines the capillary force. In some embodiments, the microstructured surface 110 provides a capillary microchannel density from about 10 per lineal cm (25/in) and up to 1000 per lineal cm (2500/in) (measured across the capillary microchannels).

As evidenced by the above explanations, the capillary action provided by the capillary microchannels 122 is primarily at the bottom surface 124 and at the base segments 160 of the corresponding ridges 120 otherwise generating the channel 122. As shown in FIG. 1B, in some embodiments the ridges 120, and in particular the corresponding base segment 160, can extend along the z-axis, generally normal to the bottom surface 124 of the capillary microchannel 122. Alternatively, in some embodiments, the base segment 160 of each of the ridges 120 can extend at a non-perpendicular angle with respect to the bottom surface 124 of the channel 122. The base segment 160 has a height $H_B$ that is measured from the bottom surface 124 of the corresponding channel 122 to a point of transition to the head segment 162. The ridge base segment height $H_B$ may be selected to provide durability and protection to the flooring surface cover article 100. In some embodiments, the ridge base segment height $H_B$ is about 25 μm to about 3000 μm, the base channel width $W_1$ is about 25 μm to about 3000 μm, and the cross-sectional ridge base segment width T is about 30 μm to about 250 μm. Finally, the film 102 can have a caliper or layer thickness $t_v$, measured from the second major face 106 to the bottom surface 124, less than about 75 μm, or between about 20 μm to about 200 μm.

In some embodiments, and as shown in FIG. 1B, the major faces 170, 172 of the primary ridges 120 along the corresponding base segment 160 may be sloped in cross section so that the width of the ridge 120 at the bottom surface 124 is greater than the width of the ridge 120 at the point of transition to the corresponding head segment 162. In this scenario, the base channel width $W_1$ of the channel 122 at the bottom surface 124 is lesser than at the point of transition to the head segment 162. Alternatively, the major faces 170, 172 along the base segment 160 could be sloped so that the base channel width $W_1$ at the bottom surface 124 is greater than at the point of transition to the head segment 162. While a shape of the capillary microchannels 122 is illustrated in FIGS. 1B and 1C as being generally rectilinear in cross-section, other shapes are also acceptable. For example, capillary microchannels of the present disclosure can alternatively be V-shaped.

Figure 4A:
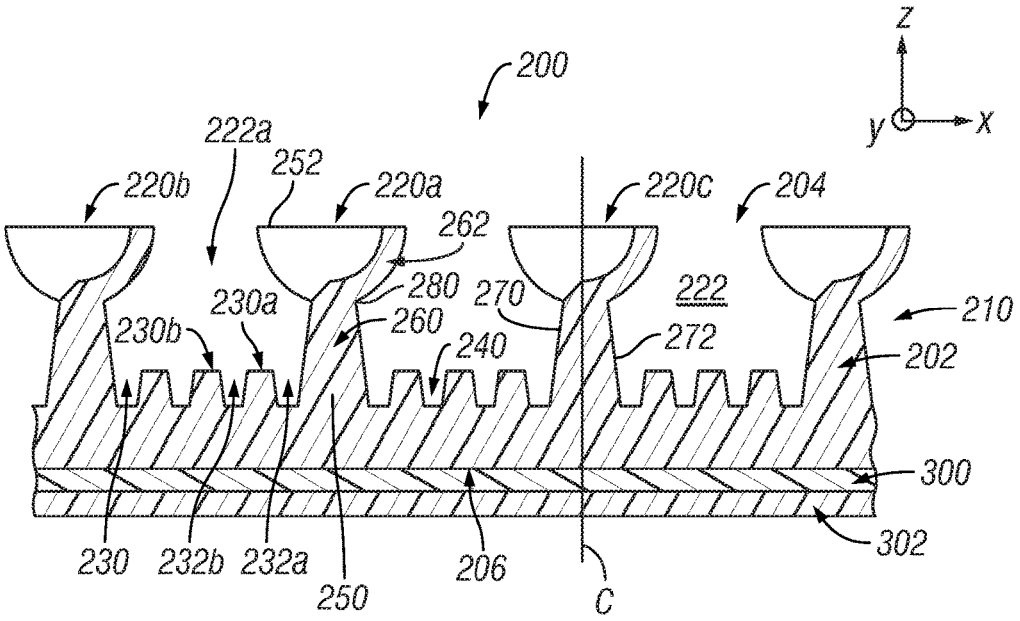
FIGS. 4A and 4B are enlarged, cross-sectional views of a portion of another flooring surface cover article in accordance with principles of the present disclosure.
Figure 4B:
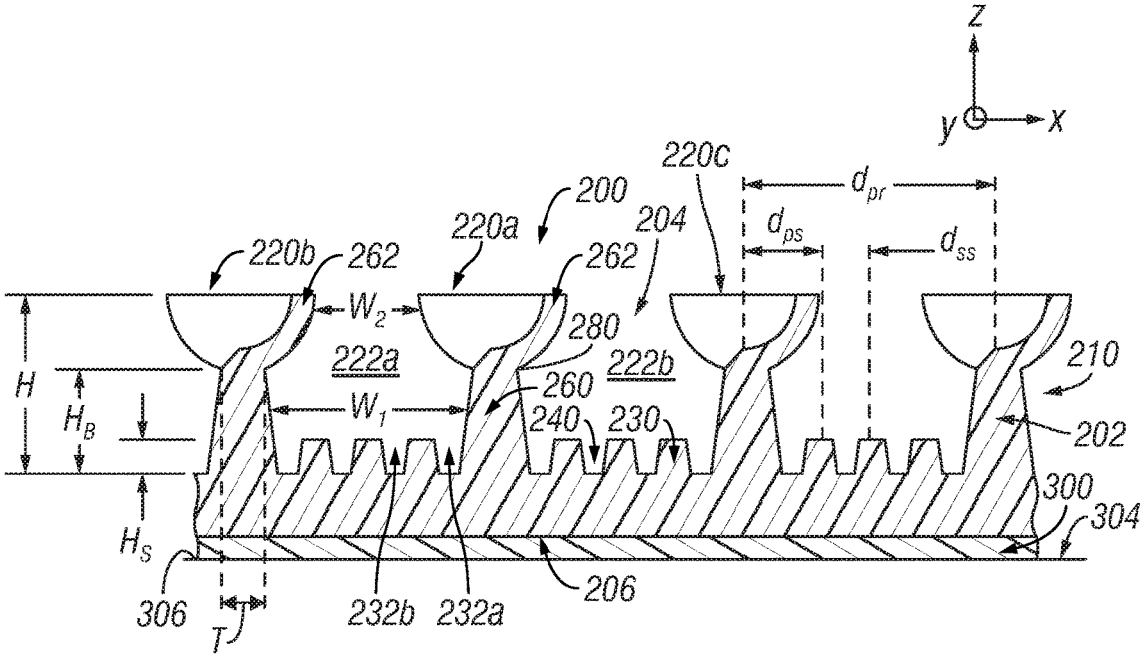

FIGS. 4A and 4B are cross sections of another flooring surface cover article 200 in accordance with principles of the present disclosure. The article 200 includes a film 202, along with an optional adhesive layer 300 and an optional release layer 302 disposed on the surface of the adhesive layer 300 opposite the film 202. The release layer 302 may be included to protect the adhesive layer 300 prior to the application of the adhesive layer 300 to a flooring surface 304. FIG. 4B shows the cover article 200 installed on the flooring surface 304 with the release layer 302 removed.

The adhesive layer 300 may allow the film 202 to be attached to virtually any type of flooring surface 304 to help manage liquid dispersion across the external surface. The combination of the adhesive layer 300 and the film 202 forms an anti-slip, liquid management tape. The adhesive layer 300 may be continuous or discontinuous. The article 200 may be made with a variety of additives that, for example, make the tape flame retardant and suitable for wicking various liquids including neutral, acidic, basic and/or oily materials.

The film 202 is configured to disperse fluid across a major or working face of the film 202 to facilitate evaporation of accumulated liquid as described below. In some embodiments, the adhesive layer 300 may be or comprise a hydrophobic material that repels liquid at an interface 306 between the adhesive layer 300 and the flooring surface 304, reducing the collection of liquid at the interface 306.

The adhesive layer 300 and the release layer 302 can optionally be included with any of the flooring surface cover articles of the present disclosure. In related embodiments, a stack of adhesive-backed flooring surface cover articles can be provided to an end-user.

The film 202 defines opposing, first and second major faces 204, 206. A microstructured surface 210 (referenced generally) is formed at the first major face 204 that otherwise serves as the working face of the cover article 200. The microstructured surface 210 includes or forms a plurality of spaced apart primary ridges 220 defining a plurality of primary channels 222, and a plurality of spaced apart secondary ridges 230 defining a plurality of capillary microchannels 232. In general terms, respective ones of the primary channels 222 are defined between adjacent ones of the primary ridges 220 (e.g., FIGS. 4A and 4B identify a first primary channel 222*a* defined between adjacent, first and second primary ridges 220*a*, 220*b*). The primary channels 222 may or may not be microchannels. One or more of the secondary ridges 230 are disposed within a corresponding one of the primary channels 222. Each of the capillary microchannels 232 is defined by at least one of the secondary ridges 230. The capillary microchannels 232 may be located between a set of secondary ridges 230 or between a secondary ridge 230 and a primary ridge 220 (e.g., FIGS. 4A and 4B identify a first capillary microchannel 232*a* defined between the first primary ridge 220*a* and an immediately adjacent first secondary ridge 230*a*, and a capillary microchannel 232*b* defined between the first secondary ridge 230*a* and an immediately adjacent second secondary ridge 230*b*). The primary and secondary ridges 220, 230 project (upwardly relative to the orientation of FIGS. 4A and 4B) from a bottom surface 240 of the corresponding channel 222, 232.

The primary ridges 220 can have any of the constructions described above with the respect to the primary ridges 120 (FIGS. 1A-1C), and can be an elongated body defining a length (not evident from the views of FIGS. 4A and 4B, but akin to the length L in the illustration of FIG. 1A), a height H, and a width T. The length is greater than the height H and the width T, and establishes a common direction or direction of extension (not evident from the views of FIGS. 4A and 4B, but akin to the direction of extension D in the illustration of FIG. 1A and otherwise perpendicular to the plane of FIGS. 4A and 4B). A shape of a portion of at least one of the primary ridges 220 is non-uniform in the direction of extension (i.e., along the corresponding length), with this non-uniform shape establishing a multidirectional elevated coefficient of friction as described in greater detail below. For example, and with specific reference to the first primary ridge 220*a* of FIGS. 4A and 4B, projection of the primary ridge 220*a* from the bottom surface 240 can be viewed as establishing a fixed end 250 opposite a free end 252. A base segment 260 extends from the fixed end 250 (in a direction of the free end 252), and a head segment 262 extends from the free end 252 (in a direction of the fixed end 250). The non-uniform shape is defined along the head segment 262.

More particularly, a cross-sectional shape of the base segment 260 in a plane perpendicular to the length of direction of extension (e.g., the x, z plane of FIGS. 4A and 4B) is substantially uniform or substantially constant (e.g., within 5% of a truly uniform or constant relationship) along at least a portion, optionally an entirety, of the length. In some embodiments, the base segment 260 is substantially linear (e.g., within 5% of a truly linear relationship) along at least a portion, optionally an entirety, of the length. In contrast, a cross-sectional shape of the head segment 262 in a plane perpendicular to the length (e.g., the x, z plane of FIGS. 4A and 4B) is non-uniform (e.g., a deviation in shape of at least 10%) along at least a portion, optionally an entirety, of the length. In some embodiments, the head segment 262 has an undulating or oscillating shape along the length as described above (and as generally reflected by FIG. 1A). The non-uniform shape of the head segment 262 can alternatively be characterized with reference to a central plane C established by the substantially uniform (optionally substantially linear) shape of the base segment 260. The primary ridges 220 each form opposing, major faces 270, 272. In a cross-sectional plane perpendicular to the length or the direction of extension (e.g., the x, z plane of FIGS. 4A and 4B), the opposing major faces 270, 272 along the base segment 260 are substantially symmetrical (e.g., within 5% of a truly symmetrical relationship) relative to the central plane C. This substantially symmetrical relationship is maintained along at least a portion, optionally an entirety, of the length. Conversely, the opposing major faces 270, 272 are non-symmetrical (e.g., a deviation of at least 10%) relative to the central plane C along the head segment 262 as described above.

The non-uniform, undulating shape of the head segment 262 entails projection of the primary ridge 220*a* "toward" the adjacent primary ridges 220 (e.g., the second and third primary ridges 220*b*, 220*c* in FIGS. 4A and 4B) at one or more locations along the length, decreasing an effective width along an upper region of the corresponding primary channels 222. For example, FIG. 4B identifies a base channel width $W_1$ of the first primary channel 222*a* between the base segments 260 of the first and second primary ridges 220*a*, 220*b*. An effective head channel width $W_2$ is defined between the head segments 262 (as described above with respect to FIGS. 1A-1C), and is less than the base channel width $W_1$. With embodiments in which the first and second primary ridges 220*a*, 220*b* have a similar shape and construction (including a shape of the base segment 260 of each of the primary ridges 220*a*, 220*b* being substantially uniform or substantially linear along the corresponding length), the base channel width $W_1$ can be substantially uniform along at least a portion of, optionally an entirety of, the first primary channel 222*a* in the direction of extension for reasons made clear below. A similar relationship is exhibited along the second primary channel 222*b*. By projecting into the primary channels 222*a*, 222*b* at various locations (spaced from or above the bottom surface 224), the head segment 262 generates a surface "over" the primary channels 222*a*, 222*b* and against which a frictional interface (e.g., kinetic frictional interface) with an external object (e.g., with a pedestrian's shoe (not shown)) can be established, thereby increasing a coefficient of friction at the working face 204 in a direction of the primary channels 222. Moreover, while the major faces 270, 272 along the head segment 262 are illustrated in FIGS. 4A and 4B as being relatively smooth, in other embodiments a surface of one or both of the major faces 270, 272 along the head segment 262 can be roughened or irregular, such as by randomly formed protrusions and/or cavities. This roughness can be imparted as part of the manufacturing steps described below, and can be achieved without the inclusion of particles embedded into the film 202.

The primary ridges 220 are configured to locate the corresponding, non-uniformly shaped head segment 262 "above" the secondary ridges 230. Stated otherwise, the non-uniform shape of the head segment 262 initiates at a point of transition 280 from the base segment 260, establishing a height $H_B$ of the substantially linear or uniform base segment 260 relative to the corresponding bottom surface 240. The secondary ridges 230 can be substantially identical in size and shape (e.g., within 5% of a truly identical relationship), and can extend along an entirety of a corresponding dimension of the film 202. A height $H_S$ of each of the secondary ridges 230 approximates or is less than the base segment height $H_B$ of each of the primary ridges 220, such that the head segment 262 of each of the primary ridges 220 is displaced away from (e.g., above relative to the orientation of FIGS. 4A and 4B) the capillary microchannels 232. In some non-limiting embodiments, the height $H_S$ of the secondary ridges 230 is between about 5 μm to about 350 μm. With these constructions, the non-uniformly shaped, coefficient of friction-enhancing head segments 262 do not overtly interfere with or otherwise obstruct liquid flow within and along the capillary microchannels 232. The non-uniform shape described above can be provided with only one, more than one, or all of the primary ridges 220. Where two or more of the primary ridges 220 embody the non-uniform shape, the so-constructed primary ridges 220 can be identical or can be different. Further, the non-uniform shape described above can be provided along only a portion of the length of one or more of the primary ridges 220, along at least a majority of the length of one or more of the primary ridges, or along an entire length of one or more of the primary ridges.

The center-to-center distance, $d_{pp}$, between adjacent ones of the primary ridges 220 may be in a range of about 25 μm to about 3000 μm; the center-to-center distance, $d_{ps}$, between a primary ridge 220 and the closest secondary ridge 230 may be in a range of about 5 μm to about 350 μm; the center-to-center distance, $d_{ss}$, between adjacent ones of the secondary ridges 230 may be in a range of about 5 μm to about 350 μm. In some cases, the primary and/or secondary ridges may have a tapering width as shown.

The primary ridges 220 can be designed to provide durability to the film 202 and the multidirectional elevated coefficient of friction as described above, as well as protection to the capillary microchannels 232, the secondary ridges 230 and/or or other microstructures disposed between the primary ridges 220.

The capillary microchannels 232 are configured to provide capillary movement of fluid in the channels 232 and across the working face 204. The capillary action wicks the fluid to disperse it across the working face 204 so as to increase the surface to volume ratio of the fluid and enable more rapid evaporation. The shape of the capillary microchannel 232, channel surface energy, and fluid surface tension determines the capillary force.

Figure 5:
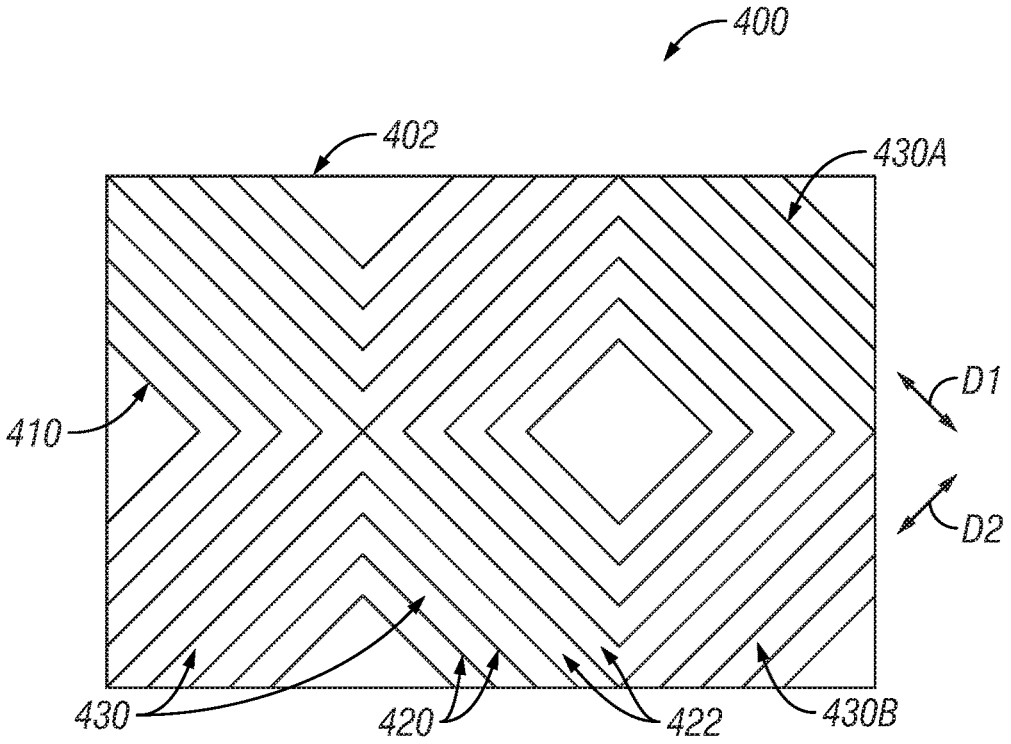
FIG. 5 is a simplified, top plan view of another embodiment flooring surface cover article in accordance with principles of the present disclosure.

While the microstructured surfaces 110 (FIG. 1A), 210 have been described as providing each of the ridges (primary or secondary) as continuous, uninterrupted bodies extending across an entire dimension of the corresponding film (and thus the channels as also being continuous or uninterrupted across the film), other constructions are envisioned. For example, FIG. 5 illustrates another embodiment flooring surface cover article 400 in accordance with principles of the present disclosure and that includes a film 402 defining a first or working face (visible in the view of FIG. 5). A microstructured surface 410 is formed at the working face and includes a plurality of primary ridges 420 and capillary microchannels 422. The primary ridges 420 can have any of the forms described above, and at least a portion of at least some of the primary ridges 420 is non-uniform along the corresponding length (e.g., along a head segment as described above). For ease of illustration, the non-uniform (e.g., oscillating) shape is not depicted in FIG. 5. The capillary microchannels 422 can also have any of the forms described above, and can optionally be formed by or between secondary ridges (not shown) commensurate with the previous descriptions.

The patterned microstructure surface 410 establishes various zones 430 of the primary ridges 420 and capillary microchannels 422, with neighboring zones 430 having a differing direction of extension. For example, FIG. 5 identifies a first zone 430A having a first direction of extension D1 and a second, neighboring zone 430B having second direction of extension D2. By providing the primary ridges 420 (and capillary microchannels 422) with differing directions of extension, an elevated coefficient or friction at the working face is generated in all directions.

The capillary microchannels described herein may be replicated in a predetermined pattern that forms a series of individual open capillary channels that extend along a major surface of the flooring surface cover article. These microreplicated microchannels formed in sheets or films are generally uniform and regular along substantially each channel length, for example from channel to channel. The film or sheet may be thin, flexible, cost effective to produce, can be formed to possess desired material properties for its intended application and can have, if desired, an attachment means (such as adhesive) on one side thereof to permit ready application to a variety of surfaces in use.

The flooring surface cover articles discussed herein are capable of spontaneously transporting fluids along the capillary microchannels by capillary action. Two general factors that influence the ability of flooring surface cover article to spontaneously transport liquids (e.g., water) are (i) the geometry or topography of the surface (capillarity, size and shape of the channels) and (ii) the nature of the film surface (e.g., surface energy). To achieve the desired amount of fluid transport capability, the designer may adjust the structure or topography of the film and/or adjust the surface energy of the film surface. In order for a microchannel to function for liquid transport by spontaneous wicking by capillary action, the microchannel is generally sufficiently hydrophilic to allow the liquid to wet the surfaces of the microchannel with a contact angle between the liquid and the surface of the film equal or less than 90 degrees. "Hydrophilic" is used only to refer to the surface characteristics of a material (e.g., that it is wet by aqueous solutions), and does not express whether or not the material absorbs aqueous solutions.

In some implementations, the films described herein can be prepared using an extrusion embossing process that allows continuous and/or roll-to-roll film fabrication. According to one suitable process, a flowable material is continuously brought into line contact with a molding surface of a molding tool. The molding tool includes an embossing pattern cut into the surface of the tool, the embossing pattern being the microchannel pattern of the film in negative relief. A plurality of microchannels is formed in the flowable material by the molding tool. The flowable material is solidified to form an elongated film that has a length along a longitudinal axis and a width, the length optionally being greater than the width.

The flowable material may be extruded from a die directly onto the surface of the molding tool such that flowable material is brought into line contact with the surface of molding tool. The flowable material may comprise, for example, various photocurable, thermally curable, and thermoplastic resin compositions. The line contact is defined by the upstream edge of the resin and moves relative to both molding tool and the flowable material as molding tool rotates. The resulting film may be a single layer article that can be taken up on a roll to yield the article in the form of a rolled good. Any polymer film manufacture technique is acceptable, such as casting, profile extrusion, or embossing.

Figure 6:
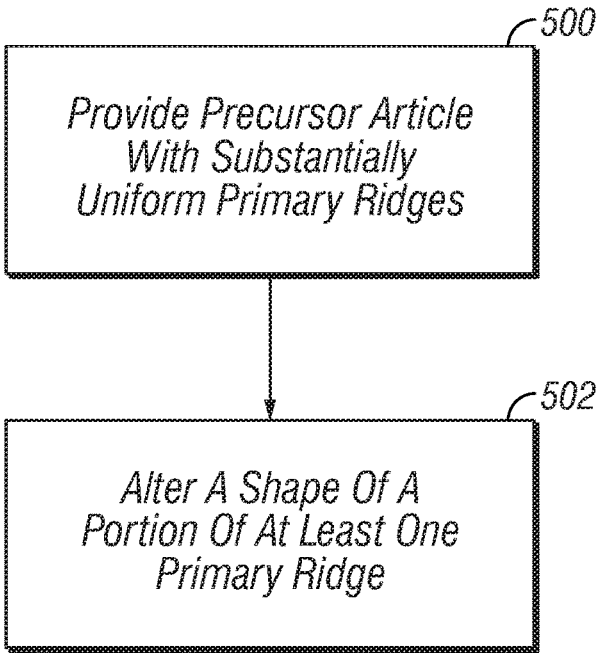
FIG. 6 is a flow diagram illustrating a method for manufacturing a flooring surface cover article in accordance with principles of the present disclosure.
Figure 7A:
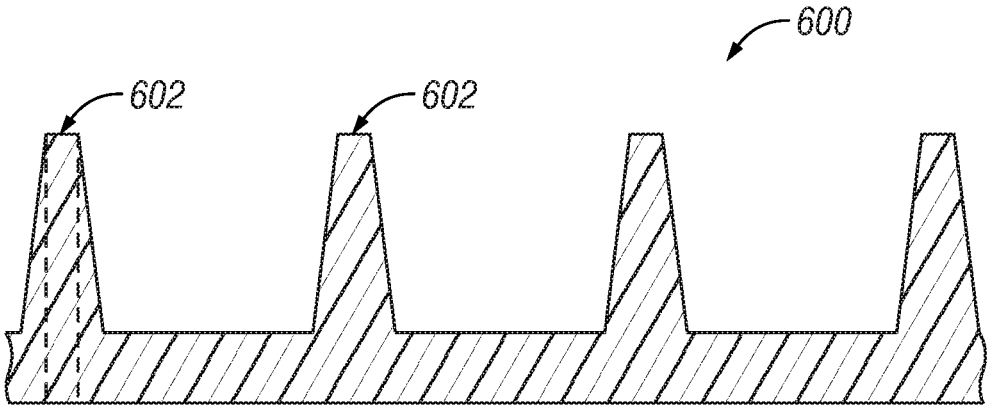
FIG. 7A is an enlarged, cross-sectional view of a portion of a precursor article useful with methods of the present disclosure.
Figure 7B:
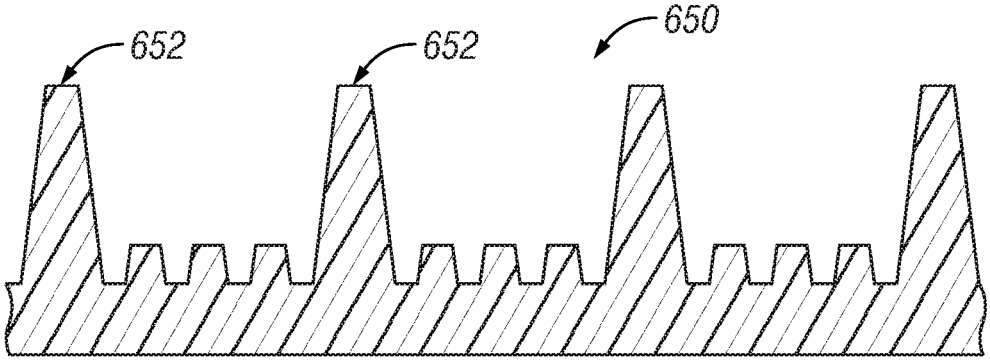
FIG. 7B is an enlarged, cross-sectional view of a portion of another precursor article useful with methods of the present disclosure.

As indicated above, the films of the present disclosure include or provide primary ridges, with a portion or segment of at least one of the primary ridges having a non-uniform shape in the corresponding length or direction of extension. In some embodiments, the primary ridges as initially provided with the film are substantially uniform and are subjected to further processing to generate the non-uniform shape. For example, FIG. 6 is a flow diagram of a method for manufacturing a flooring surface cover article in accordance with principles of the present disclosure. At 500, a precursor article is provided. The precursor article includes a film having a microstructured surface formed at a major face thereof. The microstructured surface can be akin to any of the microstructured surfaces described above, and includes at least a plurality of primary ridges and a plurality of capillary microchannels, and optionally a plurality of secondary ridges. However, and unlike the microstructured surfaces described above with respect to completed anti-slip, liquid management flooring surface cover articles, the primary ridges of the precursor article have a substantially uniform shape in the length direction, for example as generated by the extrusion embossing fabrication processes explained above. Portions of non-limiting examples of precursor articles 600, 650 are illustrated in FIGS. 7A and 7B, respectively. As generally shown, an entirety of the corresponding primary ridges 602 (FIG. 7A), 652 (FIG. 7B) have a substantially uniform shape in length or direction of extension.

Figure 8A:
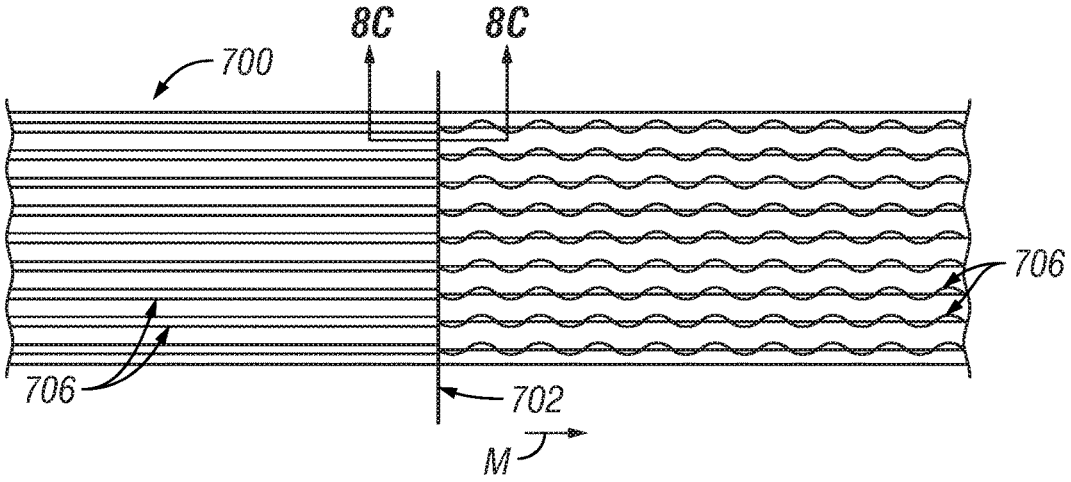
FIG. 8A is a simplified, top view of a system and method for converting a precursor article to a flooring surface cover article in accordance with principles of the present disclosure.
Figure 8B:
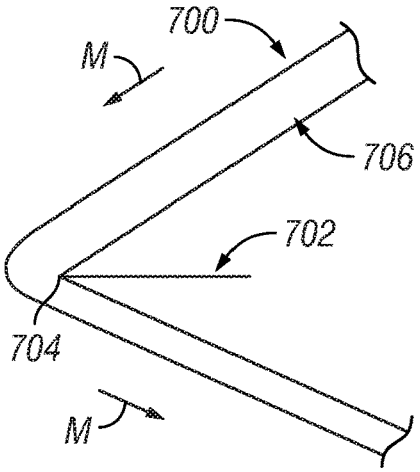
FIG. 8B is a side view of the arrangement of FIG. 8A.
Figure 8C:
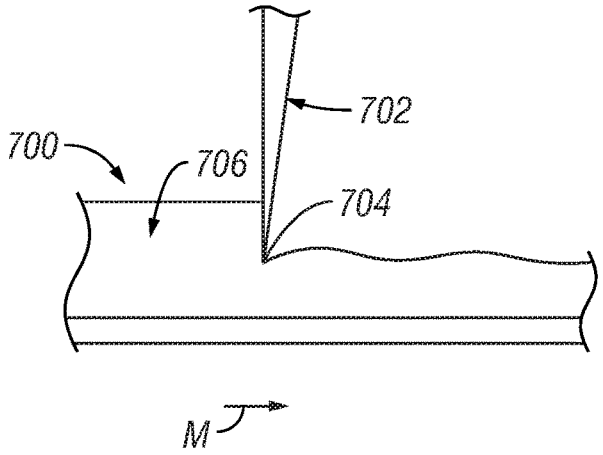
FIG. 8C is a cross-sectional view of a portion of the arrangement of FIG. 8A, taken along the line 8C-8C.

Returning to FIG. 6, a shape of a portion or segment of at least one of the primary ridges is altered or plastically deformed at 502. In some embodiments, one or all of the primary ridges is passed across a sharp edge placed perpendicular to the direction of extension D (FIG. 1A), causing the primary ridge(s) to plastically deform along or at the line of contact. For example, FIGS. 8A-8C are simplified representations of a precursor article 700 being passed along a deforming body 702 having a sharp edge 704. The sharp edge 704 is arranged perpendicular to the direction of extension D. The primary ridges 706 contact the sharp edge 704, and the precursor article 700 is moved or manipulated in the direction of extension D (movement of the precursor article 700 relative to the sharp edge 704 is indicated by the arrow M in FIGS. 8A-8C). Interface with the sharp edge 706 causes the primary ridges 706 to permanently deform at the zone of contact (much like the well-known decorative ribbon curling operation in which the user presses the ribbon again the blade of a scissors and then pulled), with only the leading or head segment of the primary ridges being deformed. Following the shape altering step 502 (FIG. 6), the microstructured surface has the constructions described above. The level or amount of deformation is dependent on the material properties of the film (e.g., elasticity), the height of the primary ridge(s), and the angle at which the precursor article 700 crosses the sharp edge 704. The deformation allows for non-directionally biased frictional characteristics in both the perpendicular and parallel directions as described above. Further, the deformation does not affect the capillary microchannels and therefore the capillary force generated thereby is not affected.

The plastic deformation processes of the present disclosure uniquely impart oscillating or wavy shapes described above, including the primary ridge "overhang" or undercut relative to the bottom surface of the capillary microchannels. As a point of reference, these geometry features would be exceedingly difficult, if not impossible, to generate using conventional film forming techniques. For example, the overhang or undercut geometry of the primary ridges would not release from a molding tool (either injection or continuous) due to the bend in the Z plane. Fabricating appropriate tooling would be equally challenging. Further, the plastic deformation processes of the present disclosure differ significantly from heat embossing to form a structure or napping the film (e.g., with sand paper) to roughen it. Using those techniques, it might be possible to produce protruding and/or receding features at the top or upper edge of the primary ridges that, in theory, might create an increased coefficient of friction; however, neither technique would generate the oscillating or wavy shapes described above that otherwise beneficially generate the "multidirectional" coefficient of friction approach angles of the present disclosure.

In some implementations, the fabrication process can further include treatment of the surface of the film that bears the microchannels, such as plasma deposition of a hydrophilic coating as disclosed herein. In some implementations, the molding tool may be a roll or belt and forms a nip along with an opposing roller. The nip between the molding tool and opposing roller assists in forcing the flowable material into the molding pattern. The spacing of the gap forming the nip can be adjusted to assist in the formation of a predetermined thickness of the film. Additional information about suitable fabrication processes for the films of the present disclosure are described in commonly owned U.S. Pat. Nos. 6,375,871 and 6,372,323, each of which is incorporated by reference herein in its respective entirety.

The films discussed herein can be formed from any polymeric materials suitable for casting or embossing, and that are inherently plastically deformable (or modified to become plastically deformable). Acceptable polymeric materials include, for example, polyolefins, polyesters, polyamides, poly(vinyl chloride), polyether esters, polyimides, polyesteramide, polyacrylates, polyvinylacetate, hydrolyzed derivatives of polyvinylacetate, etc. Specific embodiments use polyolefins, particularly polyethylene or polypropylene, blends and/or copolymers thereof, and copolymers of propylene and/or ethylene with minor proportions of other monomers, such as vinyl acetate or acrylates such as methyl and butylacrylate. Polyolefins readily replicate the surface of a casting or embossing roll. They are tough, durable and hold their shape well, thus making such films easy to handle after the casting or embossing process. Hydrophilic polyurethanes have physical properties and inherently high surface energy. Alternatively, fluid control films can be cast from thermosets (curable resin materials) such as polyurethanes, acrylates, and silicones, and cured by exposure radiation (e.g., thermal, UV or E-beam radiation, etc.) or moisture. These materials may contain various additives including surface energy modifiers (such as surfactants and hydrophilic polymers), plasticizers, antioxidants, pigments, release agents, antistatic agents and the like. Suitable fluid control films also can be manufactured using pressure sensitive adhesive materials. In some cases the capillary microchannels may be formed using inorganic materials (e.g., glass, ceramics, etc.). Generally, films useful with the present disclosure substantially retain their geometry and surface characteristics upon exposure to liquids, and are inherently plastically deformable or are modified to be plastically deformable. In some embodiments, the films of the present disclosure are substantially transparent (e.g., within 5% of a truly transparent material), such that when applied to a flooring surface, the flooring surface is readily visible through the cover article.

In some embodiments, the flooring surface cover article may include a characteristic altering additive or surface coating. Examples of additives include flame retardants, hydrophobics, hydrophilics, antimicrobial agents, inorganics, corrosion inhibitors, metallic particles, glass fibers, fillers, clays and nanoparticles.

The working surface of the film may be modified to ensure sufficient capillary forces. For example, the working surface may be modified in order to ensure it is sufficiently hydrophilic. The films generally may be modified (e.g., by surface treatment, application of surface coatings or agents), or incorporation of selected agents, such that the working surface is rendered hydrophilic so as to exhibit a contact angle of 90° or less with aqueous fluids.

Any suitable known method may be utilized to achieve a hydrophilic surface on films of the present disclosure. Surface treatments may be employed such as topical application of a surfactant, plasma treatment, vacuum deposition, polymerization of hydrophilic monomers, grafting hydrophilic moieties onto the film surface, corona or flame treatment, etc. Alternatively, a surfactant or other suitable agent may be blended with the resin as an internal characteristic altering additive at the time of film extrusion. Typically, a surfactant is incorporated in the polymeric composition from which the film is made rather than relying upon topical application of a surfactant coating, since topically applied coatings may tend to fill in (i.e., blunt) the notches of the capillary microchannels, thereby interfering with the desired fluid flow to which the present disclosure is directed. When a coating is applied, it is generally thin to facilitate a uniform thin layer on the microstructured surface. An illustrative example of a surfactant that can be incorporated in polyethylene films is TRITON™ X-100 (available from Union Carbide Corp., Danbury, Conn.), an octylphenoxypolyethoxyethanol nonionic surfactant, e.g., used at between about 0.1 and 0.5 weight percent.

Other surfactant materials that are suitable for increased durability requirements for building and construction applications of the present disclosure include Polystep® B22 (available from Stepan Company, Northfield, Ill.) and TRITON™ X-35 (available from Union Carbide Corp., Danbury, Conn.).

A surfactant or mixture of surfactants may be applied to the working surface of the film or impregnated into the cover article in order to adjust the properties of the film or article. For example, it may be desired to make the working surface of the film more hydrophilic than the film would be without such a component.

A surfactant such as a hydrophilic polymer or mixture of polymers may be applied to the working surface of the film or impregnated into the article in order to adjust the properties of the film or article. Alternatively, a hydrophilic monomer may be added to the article and polymerized in situ to form an interpenetrating polymer network. For example, a hydrophilic acrylate and initiator could be added and polymerized by heat or actinic radiation.

Suitable hydrophilic polymers include: homo and copolymers of ethylene oxide; hydrophilic polymers incorporating vinyl unsaturated monomers such as vinylpyrrolidone, carboxylic acid, sulfonic acid, or phosphonic acid functional acrylates such as acrylic acid, hydroxy functional acrylates such as hydroxyethylacrylate, vinyl acetate and its hydrolyzed derivatives (e.g. polyvinylalcohol), acrylamides, polyethoxylated acrylates, and the like; hydrophilic modified celluloses, as well as polysaccharides such as starch and modified starches, dextran, and the like.

As discussed above, a hydrophilic silane or mixture of silanes may be applied to the surface of the film or impregnated into the article in order to adjust the properties of the film or article. Suitable silanes include the anionic silanes disclosed in U.S. Pat. No. 5,585,186, as well as non-ionic or cationic hydrophilic silanes.

Additional information regarding materials suitable for microchannel films discussed herein is described in commonly owned U.S. Patent Publication 2005/0106360, which is incorporated herein by reference.

In some embodiments, a hydrophilic coating may be deposited on the surface of the film by plasma deposition, which may occur in a batch-wise process or a continuous process. As used herein, the term "plasma" means a partially ionized gaseous or fluid state of matter containing reactive species which include electrons, ions, neutral molecules, free radicals, and other excited state atoms and molecules.

In general, plasma deposition involves moving the film through a chamber filled with one or more gaseous silicon-containing compounds at a reduced pressure (relative to atmospheric pressure). Power is provided to an electrode located adjacent to, or in contact with, the film. This creates an electric field, which forms a silicon-rich plasma from the gaseous silicon-containing compounds. Ionized molecules from the plasma then accelerate toward the electrode and impact the surface of the film. By virtue of this impact, the ionized molecules react with, and covalently bond to, the surface forming a hydrophilic coating. Temperatures for plasma depositing the hydrophilic coating are relatively low (e.g., about 10 degrees C.). This is beneficial because high temperatures required for alternative deposition techniques (e.g., chemical vapor deposition) are known to degrade many materials suitable for multi-layer film, such as polyimides. The extent of the plasma deposition may depend on a variety of processing factors, such as the composition of the gaseous silicon-containing compounds, the presence of other gases, the exposure time of the surface of the film to the plasma, the level of power provided to the electrode, the gas flow rates, and the reaction chamber pressure. These factors correspondingly help determine a thickness of hydrophilic coating.

The hydrophilic coating may include one or more silicon-containing materials, such as silicon/oxygen materials, diamond-like glass (DLG) materials, and combinations thereof. Examples of suitable gaseous silicon-containing compounds for depositing layers of silicon/oxygen materials include silanes (e.g., $SiH_4$). Examples of suitable gaseous silicon-containing compounds for depositing layers of DLG materials include gaseous organosilicon compounds that are in a gaseous state at the reduced pressures of reaction chamber 56. Examples of suitable organosilicon compounds include trimethylsilane, triethylsilane, trimethoxysilane, triethoxysilane, tetramethylsilane, tetraethyl silane, tetramethoxysilane, tetraethoxysilane, hexamethylcyclotrisiloxane, tetramethylcyclotetrasiloxane, tetraethylcyclotetrasiloxane, octamethylcyclotetrasiloxane, hexamethyldisiloxane, bistrimethylsilylmethane, and combinations thereof. An example of a particularly suitable organosilicon compound includes tetramethylsilane.

After completing a plasma deposition process with gaseous silicon-containing compounds, gaseous non-organic compounds may continue to be used for plasma treatment to remove surface methyl groups from the deposited materials. This increases the hydrophilic properties of the resulting hydrophilic coating.

Additional information regarding materials and processes for applying a hydrophilic coating to a film as discussed in this disclosure is described in commonly owned U.S. Patent Publication 2007/0139451, which is incorporated herein by reference.

EXAMPLES AND COMPARATIVE EXAMPLES

Objects and advantages of the present disclosure are further illustrated by the following non-limiting examples and comparative examples. The particular materials and amounts thereof recited in these examples, as well as other conditions and details, should not be construed to unduly limit the present disclosure.

Example Flooring Surface Cover Articles

Microchannel films were prepared by extrusion embossing a low density polyethylene polymer (DOW 955i) on to a cylindrical tool according to the process described in U.S. Pat. No. 6,372,323 to provide a precursor article. The tool was prepared by diamond turning the pattern of capillary microchannels shown in FIG. 7B in negative relief. The polymer was melted in an extruder at 365 degree F. and passed through a die into a nip between the tool roll heated to 200 degree F. and smooth 70 degree F. backup roll using a nip pressure of 500 PSI. The extruder speed and tool rotation speed were adjusted to produce a film with an overall thickness of 290 microns. A hydrophilic coating bearing silane and siloxane groups was then applied to the film using a parallel plate capacitively coupled plasma reactor as described in U.S. Patent Publication No. 2007/0139451. The chamber has a powered electrode area of 27.75 $ft^2$ and an electrode spacing of 0.5 inch. After placing the embossed film on the powered electrode, the reactor chamber was pumped down to a base pressure of less than 1.3 Pa (10 mTorr). A mixture of 2% $SiH_4$ in Ar and, separately, $O_2$ gas were flowed into the chamber at rates of 4000 standard cubic centimeters per minute (SCCM) and 500 SCCM, respectively. The pressure was regulated to 990 mTorr. Treatment was carried out using a plasma enhanced chemical vapor deposition (CVD) method by coupling RF power into the reactor at a frequency of 13.56 MHz and an applied power of 1000 watts. Treatment time was controlled by moving the embossed film through the reaction zone at a rate of 10 ft/min, resulting in an exposure time of 37 s. Following the treatment, the RF power and the gas supply were stopped and the chamber was returned to atmospheric pressure.

Figure 9:
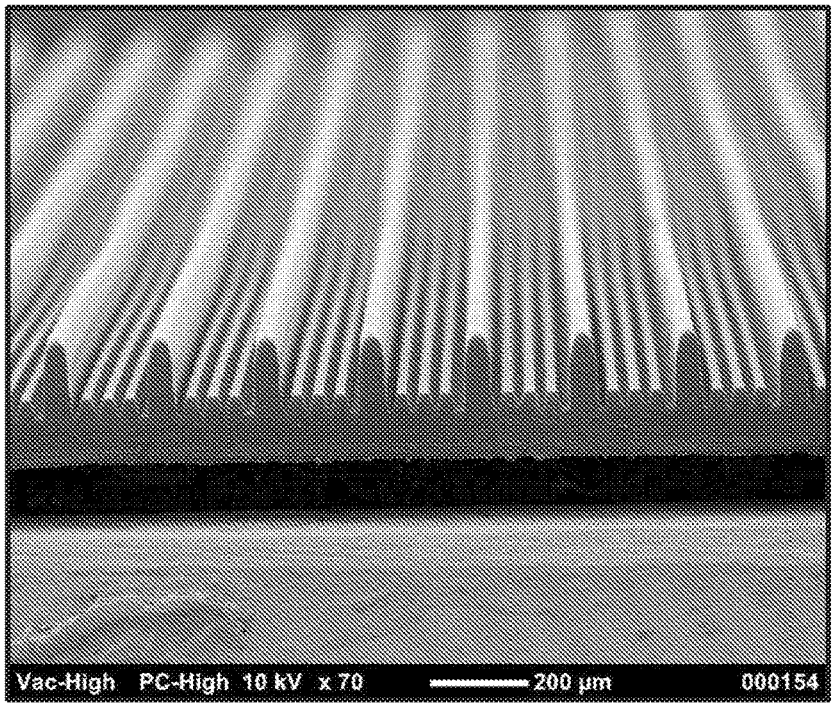
FIG. 9 is an SEM digital photomicrograph of a precursor article referenced in the EXAMPLES of the present disclosure.
Figure 10A:
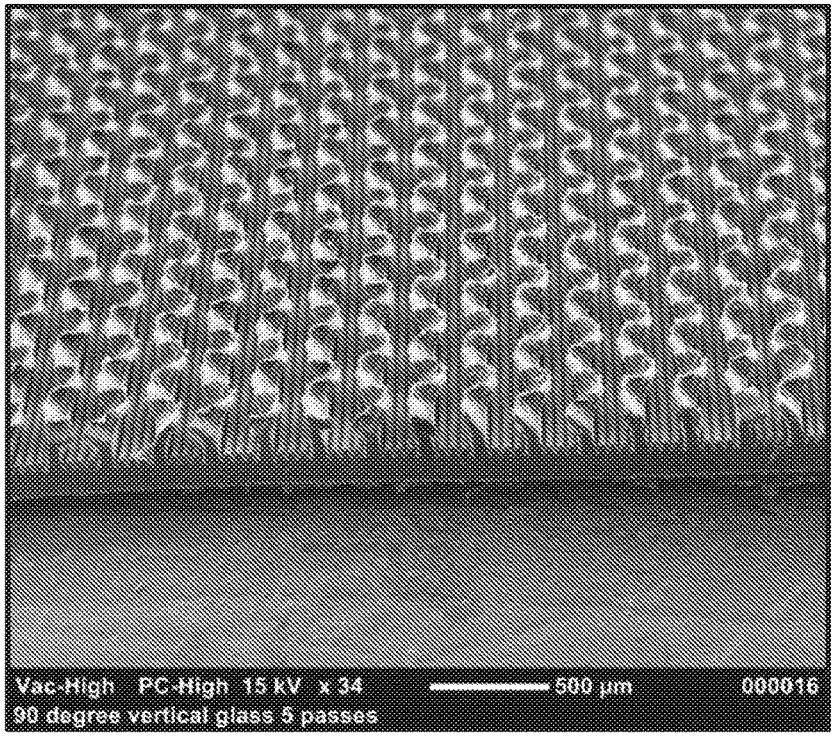
FIGS. 10A-10C are SEM digital photomicrographs of a flooring surface cover article in accordance with principles of the present disclosure and referenced in the EXAMPLES.
Figure 10B:
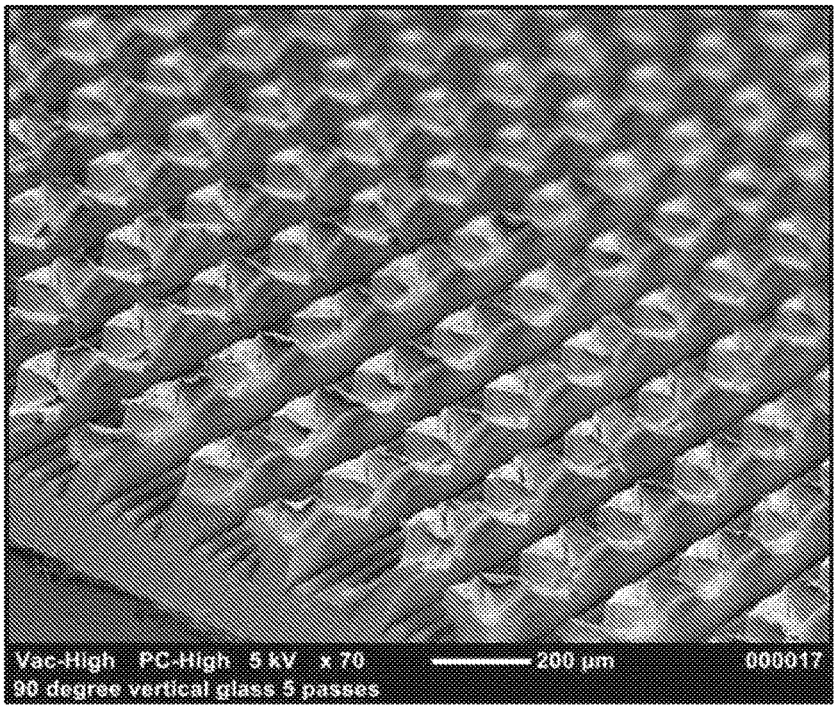
Figure 10C:
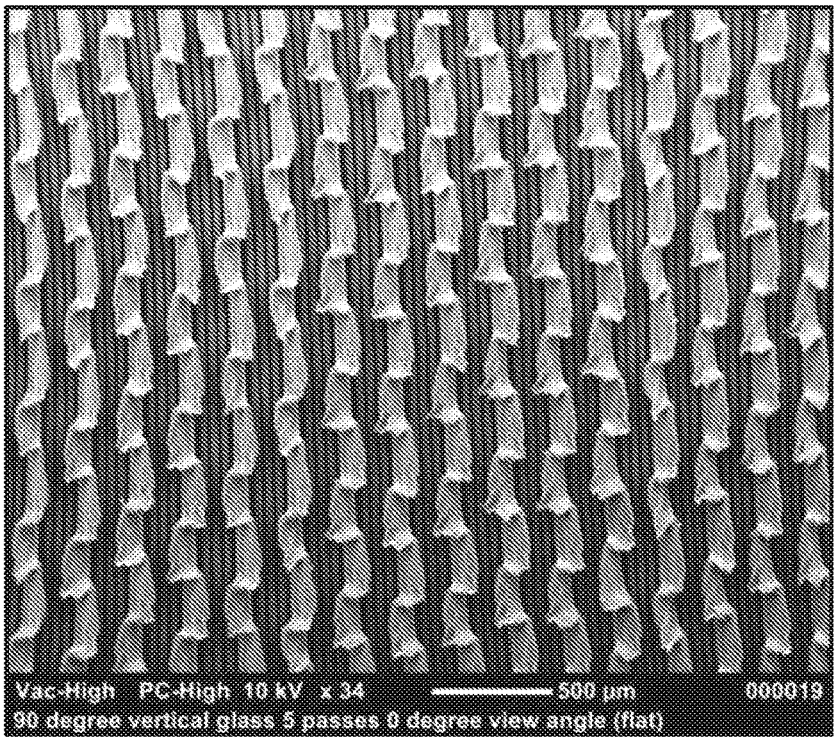

The resultant precursor articles were subsequently subjected to a plastic deformation operation to generate a non-uniform shape in the corresponding primary ridges. In particular, the precursor article was arranged relative to a sharp edge of a metal ruler (Number 1201 by General Tools Manufacturing Company, New York) such that the edge was perpendicular to a length direction of the primary ridges. With the primary ridges in contact with the sharp edge, the precursor article was manually passed or maneuvered along the sharp edge in a direction perpendicular to the plane of the sharp edge, as generally reflected by FIGS. 8A-8C. FIG. 9 is an SEM digital photomicrograph of the precursor article prior to the shaping operation; FIGS. 10A-10C are SEM digital photomicrographs following the shaping operation and indicative of the Example flooring surface cover articles.

Two sample flooring surface articles were prepared in accordance with the above descriptions, and designated as "Example A" and "Example B".

Comparative Example 1

Comparative Example 1 consisted of the precursor article described in the Example above (i.e., Comparative Example 1 was not subjected to the shaping operation). The SEM digital photomicrograph of FIG. 9 is indicative of Comparative Example 1.

Comparative Example 2

Comparative Example 2 consisted of an extruded low density polyethylene polymer (DOW 955i) film. The film of Comparative Example 2 was not embossed, and was considered to be a flat film.

Test—Coefficient of Friction

The coefficient of friction at the microstructured working face of Example A, Example B, and Comparative Example 1 was measured in the perpendicular and parallel directions with respect to the corresponding direction of extension (e.g., the direction of extension D in FIG. 1A) using a BOT-3000E digital tribometer in accordance with ASTM D2047. Five measurements were taken in each direction and recorded. The results are reported in Table 1.

TABLE 1

| Sample | Test No. | Parallel Direction | Perpendicular Direction | Average (both directions) |
|---|---|---|---|---|
| Ex. A | 1 | 0.80 | 0.88 | |
| | 2 | 0.83 | 0.87 | |
| | 3 | 0.85 | 0.91 | |
| | 4 | 0.84 | 0.88 | |
| | 5 | 0.88 | 0.89 | |
| | Avg | 0.84 | 0.89 | 0.86 |
| Ex. B | 1 | 0.91 | 0.91 | |
| | 2 | 0.88 | 0.90 | |
| | 3 | 0.89 | 0.92 | |
| | 4 | 0.91 | 0.92 | |
| | 5 | 0.89 | 0.91 | |
| | Avg | 0.90 | 0.91 | 0.90 |

TABLE 1-continued

| Sample | Test No. | Parallel Direction | Perpendicular Direction | Average (both directions) |
|---|---|---|---|---|
| Comp. Ex. 1 | 1 | 0.70 | 0.90 | |
| | 2 | 0.69 | 0.90 | |
| | 3 | 0.61 | 0.88 | |
| | 4 | 0.60 | 0.88 | |
| | 5 | 0.70 | 0.89 | |
| | Avg | 0.66 | 0.89 | 0.77 |

The coefficient of friction test results demonstrate a non-directional bias to the coefficient of friction with Examples A and B. The article of Comparative Example 1 exhibited a reduced coefficient of friction in the direction parallel with the direction of extension (i.e., parallel with the length of the ridges and microchannels). This reduction in friction in one direction may pose a potential slip risk if the article of Comparative Example 1 were used as a flooring surface cover.

Test—Capillary Force

Capillary force properties of Example A and Comparative Example 1 were estimated by measuring vertical wicking height. Three, 1 cm sample strips were cut from each of Example A and Comparative Example 1 (in line with the direction of extension). The six strips were then mounted on a thin aluminum sheet using double sided adhesive, with the base of the strips aligned to the bottom of the aluminum sheet such that the working surface was exposed. This assembly was then placed in a trough containing a deionized water solution containing hydroxypyrenetrisulfonic acid tri-sodium salt (Aldrich Chemical Company, H1529, 70 mg/500 ml). The height of the liquid after one minute was determined using a hand held UV light (365 nm) to visualize the fluorescent dye in the solution (356 nm), and recorded. The results are reported in Table 2.

TABLE 2

| Sample | Height (cm) |
|---|---|
| Ex. A-1 | 19.6 |
| Ex. A-2 | 20.0 |
| Ex. A-3 | 19.9 |
| Ex. A - Avg | 19.8 |
| Comp Ex. 1-1 | 18.8 |
| Comp Ex. 1-2 | 19.3 |
| Comp Ex. 1-3 | 19.2 |
| Comp. Ex. - Avg | 19.1 |

No statistical difference was observed in the capillary force between Example A and Comparative Example 1.

Test—Evaporation Rate

Four samples were prepared from each of Example A, Comparative Example 1, and Comparative Example 2. 500 μl of water was pipetted on to the working face each sample (i.e., the microstructured surface of the Example A and Comparative Example 1 samples), and evaporation rate was evaluated by recording the time for the mass of applied water to evaporate. The results are reported in Table 3.

TABLE 3

| Sample | Time to dry (minutes) |
|---|---|
| Ex. A-1 | 1:55 |
| Ex. A-2 | 1:18 |
| Ex. A-3 | 1:18 |
| Ex. A-4 | 1:48 |

TABLE 3-continued

| Sample | Time to dry (minutes) |
|---|---|
| Comp. Ex. 1-1 | 1:49 |
| Comp. Ex. 1-2 | 1:12 |
| Comp. Ex. 1-3 | 1:31 |
| Comp. Ex. 1-4 | 1:44 |
| Comp. Ex. 2-1 | 4:38 |
| Comp. Ex. 2-2 | — |
| Comp. Ex. 2-3 | — |
| Comp. Ex. 2-4 | 4:28 |

No statistical difference in evaporation rate was observed between Example A and Comparative Example 1. Both Example A and Comparative Example 1 exhibited an elevated evaporation rate as compared to Comparative Example 2.

The flooring surface cover articles and related methods of manufacture of the present disclosure provide a marked improvement over previous designs. The capillary microchannels readily manage and promote rapid evaporation of liquid, while the roughened or non-uniform microstructure ridges provide an elevated coefficient of friction in multiple directions. When applied to a flooring surface, the articles of the present disclosure mitigate risks of pedestrian slippage regardless of the direction in which the pedestrian is moving relative to the article and in the presence of water or other liquids. The microstructured films of the present disclosure are relatively inexpensive, and can be quickly produced on a mass production basis.

In the forgoing description, reference is made to the accompanying set of drawings that form a part of the description hereof and in which are shown by way of illustration of several specific embodiments. It is to be understood that other embodiments are contemplated and may be made without departing from the scope of the present disclosure. The detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Particular materials and dimensions thereof recited in the disclosed examples, as well as other conditions and details, should not be construed to unduly limit this disclosure. Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

What is claimed is:

1. An anti-slip, liquid management cover article for application to a flooring surface, the article comprising:

a film defining opposing, first and second major faces; and a microstructured surface formed at the first major face, the microstructured surface forming a plurality of primary ridges and a plurality of capillary microchannels each having a bottom surface, respective ones of the capillary microchannels being defined between spaced apart adjacent ones of the primary ridges;

wherein each of the primary ridges is an elongated body having a length greater than a height and a width;

and further wherein a shape of a portion of a first one of the primary ridges is non-uniform in a direction of the length of the first primary ridge;

wherein each of the primary ridges defines a base segment and a head segment in a direction of the corresponding height, the base segment extending from a fixed end at the bottom surface of a corresponding one of the capillary microchannels and the head segment extending from a free end opposite the fixed end, and further wherein the non-uniform shape of the portion of the first primary ridge is along the head segment;

wherein projection of the base segment of the first primary ridge in the direction of the corresponding height is linear, and projection of the head segment of the first primary ridge from the corresponding base segment to the corresponding free end is non-linear;

wherein a coefficient of friction along the first major face as measured by ASTM D2047 is at least 0.8 in a web direction and in a cross-web direction;

and further wherein the capillary microchannels are configured to facilitate spontaneous wicking of liquid along the capillary microchannels.

2. The article of claim 1, wherein a coefficient of friction along the portion of the first primary ridge as measured in a direction parallel with the corresponding length is within 10% of a coefficient of friction in a direction perpendicular to the corresponding length.

3. The article of claim 1, wherein a coefficient of friction along the portion of the first primary ridge as measured in accordance with ASTM D2047 is at least 0.8 in all directions.

4. The article of claim 1, wherein the head segment of the first primary ridge along the portion forms an oscillating shape in the direction of the corresponding length.

5. The article of claim 4, wherein the oscillating shape includes the head segment of the first primary ridge intermittently overhanging at least one of the capillary microchannels.

6. The article of claim 4, wherein the head segment extends from the corresponding base segment at an extension angle, and further wherein the oscillating shape of the first primary ridge establishes localized extension angle minima in the range of 90°-120°.

7. The article of claim 1, wherein a shape of at least a portion of each of the plurality of primary ridges is non-uniform in a direction of the corresponding length.

8. The article of claim 1, wherein the plurality of primary ridges further includes a second primary ridge immediately adjacent the first primary ridge, the first and second primary ridges combining to define a first primary channel, and further wherein the microstructured surface further includes a first secondary ridge disposed within the first primary channel and having a height less than a height of each of the first and second primary ridges, the first secondary ridge defining a side of a first one of the plurality of capillary microchannels.

9. The article of claim 8, wherein the first primary ridge defines a base segment and a head segment in a direction of the corresponding height, the base segment extending from a fixed end of the bottom surface of a corresponding primary channel and the head segment extending from a leading end opposite the fixed end, and further wherein the non-uniform shape of the portion of the first primary ridge is along the head segment, and even further wherein the height of the base segment is greater than the height of the first secondary ridge.

10. The article of claim 1, wherein the film includes a linear low density polyethylene material.

11. The article of claim 1, wherein the film includes a hydrophilic coating.

* * * * *